US007623010B2

(12) United States Patent
Liu

(10) Patent No.: US 7,623,010 B2
(45) Date of Patent: Nov. 24, 2009

(54) ELECTRICAL SWITCH

(76) Inventor: Ping Liu, 82-1, No. 2, Ganjingzi Road, Liaoning Province P.R. (CN) 116031

( * ) Notice: Subject to any disclaimer, the term of this patent is extended or adjusted under 35 U.S.C. 154(b) by 0 days.

(21) Appl. No.: 10/558,844

(22) PCT Filed: May 28, 2004

(86) PCT No.: PCT/CN2004/000563

§ 371 (c)(1),
(2), (4) Date: Oct. 5, 2006

(87) PCT Pub. No.: WO2004/107375

PCT Pub. Date: Dec. 9, 2004

(65) Prior Publication Data

US 2007/0126538 A1 Jun. 7, 2007

(30) Foreign Application Priority Data

May 29, 2003 (CN) ..... 03 1 40553

(51) Int. Cl.
*H01H 75/00* (2006.01)
*H01H 77/00* (2006.01)
*H01H 83/00* (2006.01)

(52) U.S. Cl. ..... 335/6; 335/15; 335/63; 335/71; 335/78; 335/91; 335/113; 335/121; 335/126; 335/132; 335/164; 335/165; 335/172; 335/173; 335/185; 335/201; 335/295; 335/60; 335/89; 335/107; 335/111; 335/114

(58) Field of Classification Search ..... 335/6, 335/15, 63, 71, 75, 78, 91, 113, 121, 126, 335/131, 132, 164, 165, 172, 173, 185, 201, 335/295, 60, 89, 107, 111, 114
See application file for complete search history.

(56) References Cited

U.S. PATENT DOCUMENTS 3,659,235 A * 4/1972 Scheibel et al. ..... 335/35

(Continued)

FOREIGN PATENT DOCUMENTS

| | | |
|---|---|---|
| CN | 86 1 05019 | 4/1987 |
| CN | 2036311 U | 4/1989 |
| CN | 1042266 A | 5/1990 |
| CN | 1042796 | 6/1990 |

(Continued)

OTHER PUBLICATIONS

Wang, Jihzhu, International Search Report of PCT/CN2004/000563, dated Sep. 9, 2004 of the ISA/CN.

*Primary Examiner*—Lincoln Donovan
*Assistant Examiner*—Mohamad A Musleh
(74) *Attorney, Agent, or Firm*—Fish & Richardson P.C.

(57) ABSTRACT

An electrical switch for connecting and breaking a circuit including a connecting and breaking mechanism for connecting and breaking the circuit provided with at least a set of movable contacts and stationary contacts; a electromagnetism drive mechanism for controlling the contacts to be actuated so as to realize closed circuit; a housing for accommodating the movable contact and stationary contact; an arc-extinguishing mechanism disposed in the housing and corresponded to the movable and stationary contact; a case connected to a base for accommodating the electromagnetism drive mechanism; a bedplate associated with the case; and a holding mechanism disposed on the bedplate for holding the contacts to connect the circuit, the electromagnetic holding mechanism is electromagnetic and has a set of electromagnetic attracting mechanism in which the movable iron core is made to be a pothook or a baffle mechanism, the movable iron core is attracted so that the pothook or baffle keeps the switch closed by means of hitching or ramming the movable bolt when the electromagnetic attracting mechanism is powered on. The electrical switch has a structure in which it has a breakaway mechanism using winding, in which the remanence being small and the feedback force being large and the action of the limiting current being rapid, it can break the large short current as air switch.

19 Claims, 12 Drawing Sheets

U.S. PATENT DOCUMENTS 4,292,611 A * 9/1981 Bresson et al. ..... 335/6
4,307,358 A * 12/1981 Haury et al. ..... 335/6
4,631,507 A * 12/1986 Guery et al. ..... 335/27
4,713,636 A * 12/1987 Lemmer et al. ..... 335/35
4,800,352 A * 1/1989 Haury et al. ..... 335/132
4,975,665 A * 12/1990 Ohishi et al. ..... 335/14
5,089,796 A * 2/1992 Glennon et al. ..... 335/172
5,163,175 A * 11/1992 Mori et al. ..... 335/132
5,252,933 A * 10/1993 Kamino et al. ..... 335/172
5,933,065 A * 8/1999 Duchemin ..... 335/190
6,150,909 A * 11/2000 Meier ..... 335/132

FOREIGN PATENT DOCUMENTS

CN 2165524 Y 5/1994
CN 2308162 Y 2/1999
CN 1242868 1/2000
JP 9-265879 10/1997

* cited by examiner

ELECTRICAL SWITCH

This application claims the benefit of PCT Application No. PCT/CN2004/000563 filed May 28, 2004 which further claims the benefit of Chinese Patent Application No. 03140553.3 filed May 29, 2003. The entire disclosures of PCT Application No. PCT/CN2004/000563 and Chinese Patent Application No. 03140553.3 (Publication No. 1553464A) are incorporated by reference as part of the specification of this application.

FIELD OF THE INVENTION

The present invention relates to an apparatus for connecting and breaking a circuit between a load and a power supply, which can be called an electrical switch and may be one single phase or three-phase switch. The present invention mainly introduces one three-phase electrical switch, whose load is a three-phase AC motor.

DESCRIPTION OF THE RELATED ART

In 1983, an Integral 32 combination electrical appliance was put on the market by Telemecanique (TE) Company in France, it represents the world's level today, FIG. 45 is view showing the structure of its switch portion, in which the connection and break of the switch are controlled by an attracting coil WI. A current limiting mechanism comprises a current limiter W3, a percussion bar B5, and a striking bar 65. Z1 denotes a tension spring, Z2 denotes a spring, the force of the tension spring Z1 is greater than that of Z2. When the attracting coil W1 is powered on, a connection board 20 rises the spring Z2 so as to make the contact of the switch be closed, when the attracting coil W1 is powered off, the tension spring Z1 draws and presses Z2 so as to make the contact be disconnected. When an over-current flows through the switch, the current limiter W3 attracts percussion bar B5 to make the striking bar 65 strike tension spring Z1, so that the movable contact and the stationary contact can be disconnected at a rapid speed. The bigger the current is, the faster the disconnection speed is. TE Company has been granted two Chinese Patents No. 89108203 and No. 89108547, respectively.

Shanghai Electrical Power Science and Research Institute has developed the same product as TE Company, and has been granted Chinese Patent No. 95227387.

The present inventor disassembled and analyzed the product manufactured by TE Company, and found out that it was too complicated to describe, at the same time, the product always keeps in the closed state as a contactor, and the power consumption is high. In contrast, the present switch is simpler, and the power consumption is lower, the present inventor has produced the sample.

German Moeller Company has also produced a compact motor starter, it has only changed the conventional air switch, contactor and thermorelay into the inserted switch so that the entire system has a small size.

SUMMARY OF THE INVENTION

To solve the problem described above, in accordance with one aspect of the present invention, there is provided an electrical switch for connecting and breaking the circuit, said electrical switch centralizes all the functions of the breaker, the contactor and the protective relay, it serves to connect, break and protect the circuit, not only to be operated frequently as the contactor, but also to break the larger short circuit current as the air switch. The switch has a small size, and a compact structure, in addition, it can save the electric energy.

In order to achieve the above and other objects, the present invention provides an electrical switch for connecting and breaking a circuit, including: a connecting and breaking mechanism for connecting and breaking the circuit provided with at least a set of movable contacts and stationary contacts; a electromagnetism drive mechanism for controlling the contacts to be actuated so as to realize closed circuit; a housing for accommodating the movable contact and stationary contacts; an arc-extinguishing mechanism disposed in the housing and corresponded to the movable and stationary contact; a case connected to a base for accommodating the electromagnetism drive mechanism; a bedplate associated with the case; and a holding mechanism disposed on the bedplate for holding the contacts to connect the circuit after the contacts are connected, the holding mechanism is electromagnetic and has a set of electromagnetic attracting mechanism in which the movable iron core is made to be a pothook or a baffle mechanism, the movable iron core is attracted so that the pothook or baffle keeps the switch closed by means of hitching or ramming the movable bolt when the electromagnetic attracting mechanism is powered on.

Said electrical switch further includes a coil, a conducting magnet plate, a bracket, and a tension spring; the pothook or baffle intersects the top end of the conducting magnet plate, and has an inclined plane at a position where is contacted with the movable bolt so as to disconnect the movable bolt.

In another aspect of the present application, there is provided an electrical switch for connecting and breaking the circuit, including: a connecting and breaking mechanism for connecting and breaking the circuit provided with at least a set of movable contacts and stationary contacts; a electromagnetism drive mechanism for controlling the contacts to be actuated so as to realize closed circuit; a house for accommodating the movable contact and stationary contact; an arc-extinguishing mechanism disposed in the housing and corresponded to the movable and stationary contacts; a case connected to a base for accommodating the electromagnetism drive mechanism; a bedplate associated with the case; and a holding mechanism, which is an elasticity type, disposed on the bedplate for holding the contacts to connect the circuit after the contacts are connected; a pothook or baffle of said holding mechanism keeps the switch closed by hitching or ramming the movable bolt by means of elasticity, said holding mechanism further includes a spring, a stop button, and a reset button, said pothook or baffle abuts against the movable bolt.

Said electrical switch further includes a current limiting mechanism disposed on the bedplate for detecting and limiting over-current, said over-current mechanism includes a set of electromagnet corresponding to each of phase circuit and a set of connecting rod mechanism connected with thereof, said connecting rod mechanism has a rod which can rapidly thrust aside the movable iron core of the holding mechanism when the over-current occurs, and further includes a spring, a pushing plate, a pushing bar and a bracket.

Said electrical switch further includes a selection switch mechanism disposed on the Bedplate, said selection switch mechanism comprises a set of movable and stationary slide slices in which the movable slide slice moves along with the turnbutton bar, said selection switch may move both in the rotary direction and in the vertical direction to control the operating state of the switch.

Said electrical switch further includes a selection switch mechanism disposed on the bedplate, said selection switch mechanism comprises two sets of micro buttons and a mechanism for connecting and breaking the circuit comprised of a turnbutton, a turnbutton bar, a movable slide slices and a stationary slide slices.

Said electrical switch further includes a comprehensive protector, said comprehensive protector has a thermal element action means corresponding to each phase circuit, the thermal element action means can disconnect the said switch when the over-current occurs and further has a phase failure detecting mechanism corresponding to the main circuit which can disconnect said switch in detecting the phase failure.

Said switch is a combination type one, it comprises a switch portion and a protection portion, which will be described with reference to FIGS. 10, 11 and 17, it may be a selective type or a nonselective type depending on whether there is a selection switch, the selective type employs the circuit shown as FIG. 1, while the nonselective type employs the circuit shown as FIG. 2 or FIG. 3.

Said switch portion includes a contact and closing mechanism, a holding mechanism using a pothook or a baffle, a limiting current mechanism, a connecting and supporting mechanism and a selection switch mechanism.

Said protection portion includes an overload protection mechanism, an over-current protection mechanism, a phase failure protection mechanism and a reset mechanism.

Now, the operation of the switch will be described in details below.

When the attracting coil W1 is powered on, the movable and stationary iron cores and the contacts are closed to make the holding coil W2 be electrified so as to attract the pothook E1, which can hook or repel the movable bolt 19. At this time, though the coil W1 is powered off, the closing state is maintained by the coil W2 attracting the pothook E1, when it needs to disconnect the switch, the coil W2 is powered off, the pothook E1 rapidly breaks away the movable bolt 19 by a tensile force of the tension spring Z1 and a component force of the spring Z2.

When the pothook E1 breaks away the movable bolt 19, the switch trips to make the movable iron core and the movable contacted and the stationary iron core and the stationary contact are rapidly separated from each other due to the spring Z2.

When the over-current occurs in the switch, the selection switch ejects immediately to turn off the switch K2, K3 and SA, and strikes the pothook E1 to disconnect from the hook so as to turn off the switch. The switch can be turned on only when the reset button of the selection switch is pressed.

When the overload or over-current occurs in the switch, the protection mechanism breaks away the contact K1 to make the coil W2 be powered off and make the switch trip. The switch can be turned on again only when the protection mechanism is reset.

Generally, the air switch is manually operated, its disconnection capacity is high (as an example of the switch 32 A-400V, it has a disconnection capacity of 50000 A as 1562 times as its rated current), but its lifespan is short, and it is difficult to start frequently. In contrast, since the contactor is electrically operated, its lifespan is long, it can be started frequently, but it only has a disconnection capacity as 10 times as its rated current.

The reason why the disconnection capacity of the air switch is higher than that of the contactor is mainly that its disconnection speed is faster. The present inventor thinks that the reason why the disconnection speed of the contactor is slower has two factors: the one is that the contactor is heavier than the air switch in weight, the other one is mainly that there is magnetic remanence in the contactor when it is powered off instantly.

At present, it is necessary to have the following functions in the electrical machine controlling system, that is, a overload protection, a short-circuit protection, a separation control, a rapid and easy control. These functions are generally carried out through the air switch, the contactor and the overload relay. The switch has all above functions, when it is turned on, the coil W1 is turned off immediately, and the magnetic remanence is small.

Compared with said product, the switch has many following advantages: 1) the switch has a small size, and a simple structure, it can be near-controlled, be stopped and be remote-controlled by the selection switch, its operation is convenient and flexible; 2) the holding coil has a capacity less 5% than that of the attracting coil, and it saves energy; 3) since the switch employs the pothook structure, the pressure of its contact keeps stable, it is different from the conventional attracting coil which is often affected by the voltage variation of the power network which fluctuate in a sine wave forms, so the contact can be easily damaged; 4) the over-current action of the switch is short, and the response speed is rapid.

In particular, the switch has a good practical effect, though it is said that the product manufactured by TE has a disconnection capacity of 50 KA, it is infrequency in practice. For example, the maximum short circuit current in the transformer of 560 KVA is only 16.7 KA, and that of the transformer of 1800 KVA is only 48 KA. In practice, the switch may usually be partial short, sometimes the short circuit current is several times more than the rated current. It is impossible to make the striking bar of the product manufactured by TE be actuated, or make the breaker of the starter in the compact motor be actuated, in contrast, it can make the loop voltage on the attracting coil drop, they will be disconnected because the attracting force is smaller than the feedback force. Since some certain attracting forces also produce in the coil, the disconnection speed is slow, the contact tends to be turned out due to the pulling arc. Sometimes, though the load is not shorted, the voltage on the power network is low, said contact of the switch also be easily damaged.

Since the present switch employs the tripping disconnection mechanism, its disconnection speed is mainly affected by the feedback force, even if the trip occurs in the holding coil due to the dropping voltage, the disconnection speed keeps constant, accordingly, the aforesaid problems do exist at all, therefore, the present switch is more practical and more reliable.

Since the present switch has a structure in which it has a breakaway mechanism using winding, in which the magnetic remanence being so small to be negligent, meanwhile, its feedback force may be designed to be large. The action of the limiting current mechanism may be rapid. Therefore, it can break the large short circuit current as an air switch while it saves the energy.

BRIEF DESCRIPTION OF THE DRAWINGS

The above and other objects, features and advantages of the present invention will become clearer from the following description of the specific preferred embodiments with reference to the attached drawings, in which:

FIG. 4(*b*) is a view schematically showing a state after the selective switch is disconnected;

FIG. 4(*c*) is a view showing the action path of the selective switch;

FIG. 18 (*a*) is a view showing the circuit diagram of the structure of the electronic tripper;

FIG. 53 is a view schematically showing the position of the turnbutton when the switch shown in FIG. 52 is turned on;

DESCRIPTION OF THE PREFERRED EMBODIMENTS

The electrical switch according to the present invention will hereinafter be described in details by reference to the attached drawings.

1. The Electrical Circuit of the Electrical Switch

Figure 1:
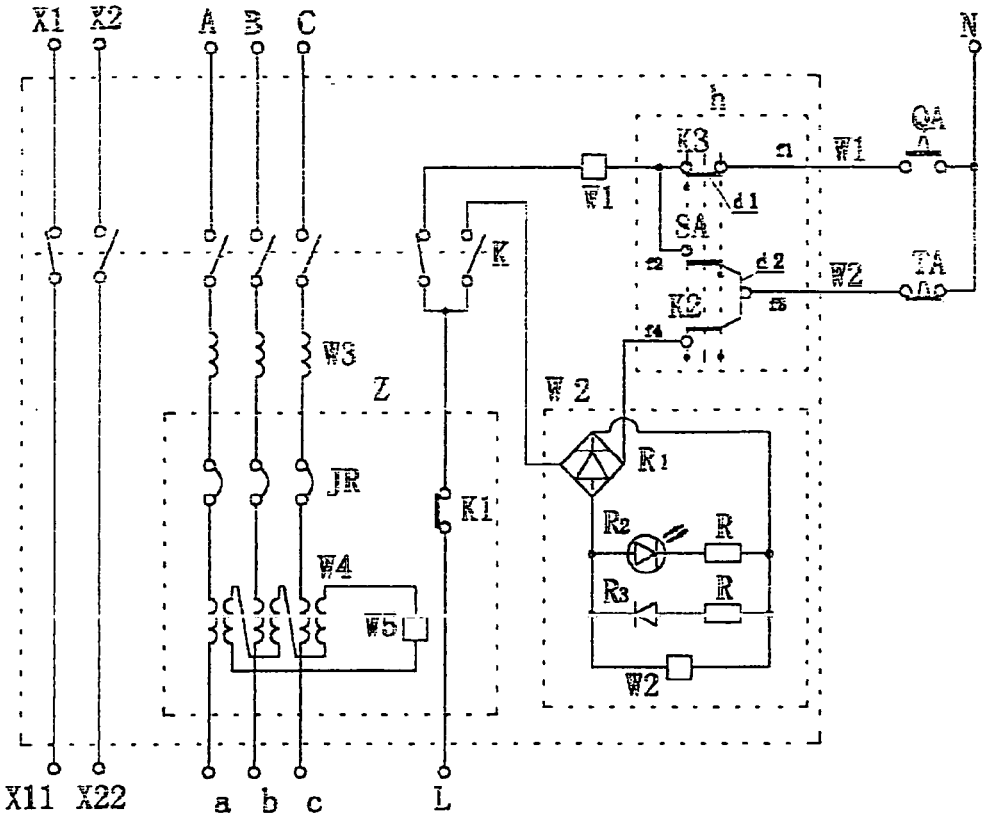
FIG. 1 is a view showing the circuit diagram of a selective electrical switch.

FIG. 1 is a circuit diagram shows one of the features of the present invention, in which after the switch is attracted and closed by means of the contact inside the switch, the circuit can assure the attracting coil to be powered off immediately, while can keep the holding coil be powered on so as to be on a self-protected state, if the switch is selected to be operated by the remote button, it can reduce one self-protection wire compared with the contactor, therefore, it is simple.

FIG. 1 shows one preferred circuit of the selective electrical switch, in which the elements and the circuit in the switch are disposed in the large broken line block, A, B, C are input source terminals respectively, a, b, c are input load terminals respectively, x1, x11, x2, x22 are output assistant contact terminals respectively, L, N are control source terminals, W1, W2 are control terminals, K is the main contact and the assistant contact of the switch, W1 represents attracting coil, W3 represents over-current control mechanism, there is a comprehensive protector in the Z block, some comprehensive protectors contain the over-current control mechanism W3, there is a holding coil mechanism in the block of the control terminal W2. It includes a holding coil W2, a rectification element, a continuation current element and a display element etc, which are all assembled on the element board EJ, there is a selective switch in h block. The attracting coil in the circuit also uses a DC source. The other kind of switch may employ the circuit shown in FIG. 2 or FIG. 3.

2. The Operation of the Selective Switch and the Elective Switch

The electrical switch includes the selective switch and the nonselective switch, in which the operation of the selective switch depends on the selection switch.

The selective switch is one of the features of the present invention, it has two functions of selecting the operation state and breaking the electrical circuit, and has a rotary action and a vertical action.

Figure 4:
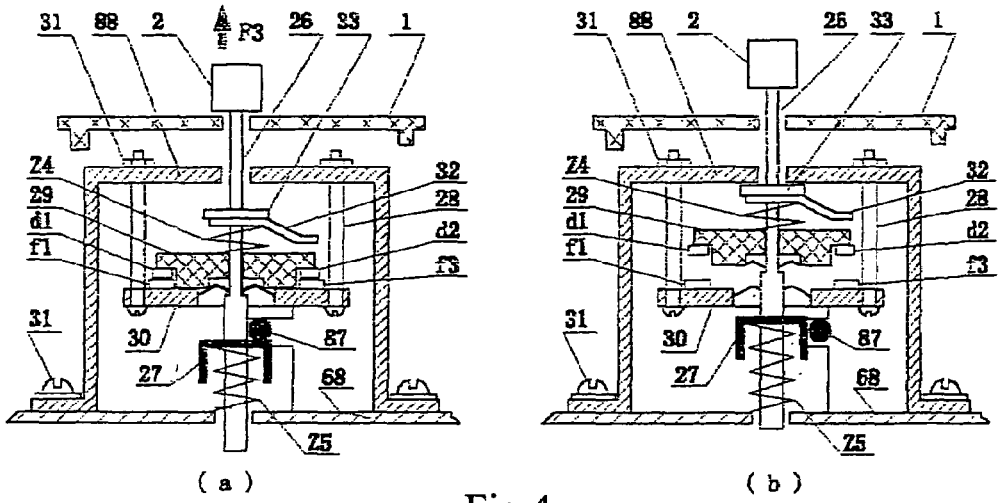
FIG. 4(*a*) is a view schematically showing a state after the selective switch is closed.
Figure 5:
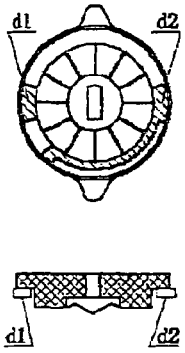
FIG. 5 is a view schematically showing the structure of the movable slide slice shown in FIG. 4(*a*) and FIG. 4(*b*)
Figure 6:
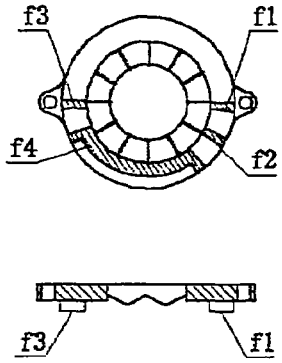
FIG. 6 is a view schematically showing the structure of the fixed slide slice shown in FIG. 4(*a*) and FIG. 4(*b*)
Figure 7:
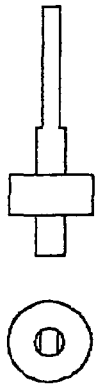
FIG. 7 is a view schematically showing the structure of the turn-button bar shown in FIG. 4(*a*) and FIG. 4(*b*)
Figure 4C:
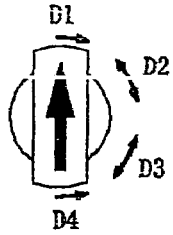
Figure 8:
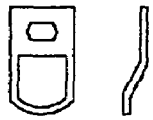
FIG. 8 is a view schematically showing the structure of the elastic baffle shown in FIG. 4(*a*) and FIG. 4(*b*)

FIG. 4(*a*) and FIG. 4(*b*) are views schematically showing a structure of the selective switch, portion 1*h* in FIG. 1 is a block diagram showing its circuit, it has three switch K2, K3, SA, also includes a turnbutton 2 and turnbutton bar 26. There is a bowl-shaped ring 27 in the turnbutton bar 26 in which its top end is flat, its bottom end is round, as shown FIG. 7. Z4, Z5 represent springs, the reference number 28 represents a branch pipe, the reference number 29 represents a movable slide slice, in which an elongated hole matched with the turnbutton bar 26, a rim and a contact area are sequentially arranged on the middle portion of the movable slide slice 29, and the movable contacts dl, d2 are disposed on the movable slide slice 29. As shown FIG. 5, the buttons on two sides of the movable slide slice 29 are to limit the rotary range. The reference number 30 represents the fixed slide slice, in which a hole passing through ring 27, a cog circle, and a contact area are sequentially arranged on the middle portion of the fixed slide slice 30, and the fixed contacts f1, f2, f3 and f4 are disposed on the fixed slide slice 30, the buttons on its two sides are to fix these above elements, as shown FIG. 6. There are grooves among these contacts to increase the creepage distance. The rims of the movable and fixed slide slices fit with each other to adjust the gear. The reference number 32 represents a pushing block made of elastic material, as shown FIG. 8.

While the selective switch being assembled, the fixed slide slice 30, the spring Z4 and the pushing shield 32, whose front ends are blocked by the side of the turnbutton 26, their back ends are supported by the pad 33 which is riveted on the turnbutton bar 26, are muff-coupled in serial on the turnbutton bar 26. The back end of the spring Z4 may be directly blocked by the bracket 88. The fixed slide slice 30 may be disposed on the back end of the spring Z4, also may be directly blocked by the bracket 88. The fixed slide slice 30 can move in the direction of the elastic force of the spring Z4, the fixed slide slice 30 and the pushing block 32 can rotate along with the turnbutton bar 26. Then, the turnbutton bar 26 passes through the fixed slide slice 30, and is fixed on the bracket 88 by the fixed member 31 and the branch pipe 28. After being sleeved on the spring Z5, the turnbutton bar 26 is fixed on the bedplate 68 of the switch, as shown FIG. 4(*a*) and 4(*b*).

The selective switch has three-position type and four-position type, whose operation path is shown as FIG. 4(*c*), it can rotate in the direction shown as the arrow in the figure, and select the operation state, the operation state of each block position follows as:

D1 remote control: when the selective switch directs to this position, K2, K3 are turned on, SA is turned off. At this time, the switch is only remote controlled, turned on or stopped.

D2 stop: when the selective switch directs to this position, K2, K3 and SA are all turned off, the power supply is controlled by the switch, and the switch is powered off.

D3 direct connection: when the selective switch directs to this position, K2 and SA are turned on, the switch is powered on.

D4 direct lock: only the four-position type selective switch has a direct connection locking position and the pushing block 32. When the selective switch turns from the direct connection position to the direct connection locking position, K2, K3 and SA are all turned off, a pothook E1 is opposed against the pushing block 32 to lock the movable bolt 19 so as to make the switch closed such that the pushing block can maintain in the holding state.

Figure 9:
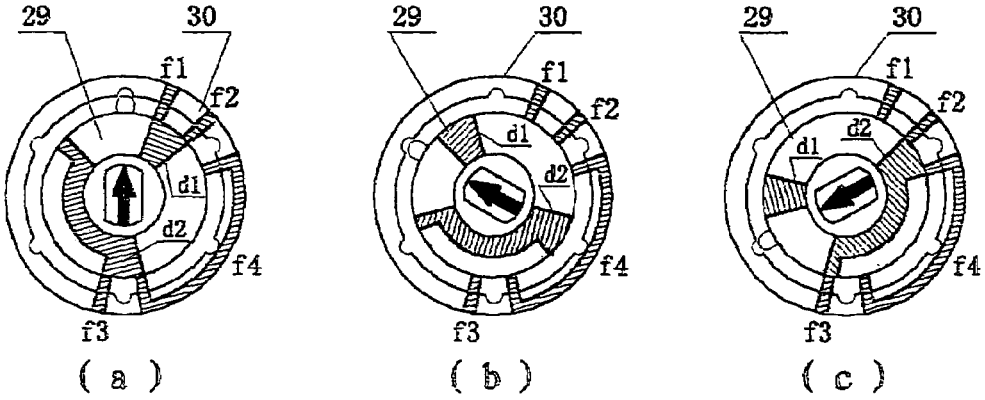
FIG. 9 is a view schematically showing the operation position of the selective switch, in which FIG. 9(*a*) is a state of being remote-controlled, FIG. 9(*b*) is a state of being stopped, FIG. 9(*c*) is a state of being directly connected.

The connecting and breaking state of the three-position type selective switch in every blocking position is shown as FIG. 9, in which (a) indicates the remote control, (b) indicates stop, (c) indicates the direct connection.

Figure 2:
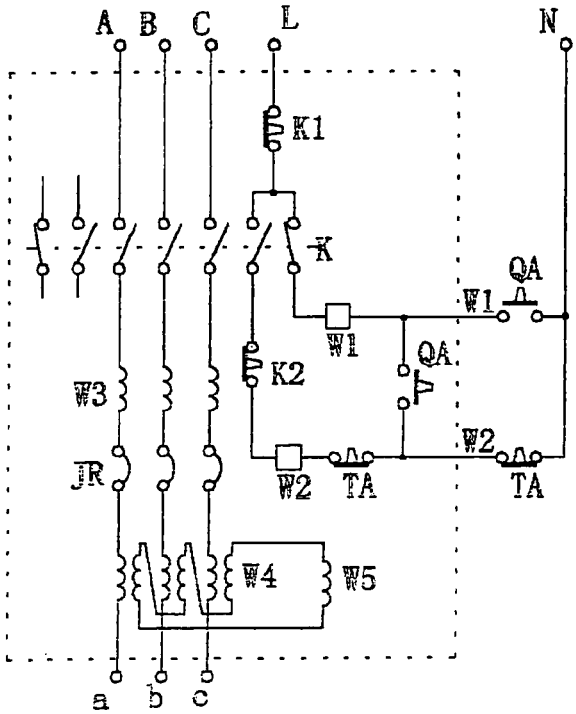
FIG. 2 is a view showing the circuit diagram of a nonselective electrical switch.

The nonselective electrical switch does not have a selective switch, and it employs the circuit shown as FIG. 2.

Figure 10:
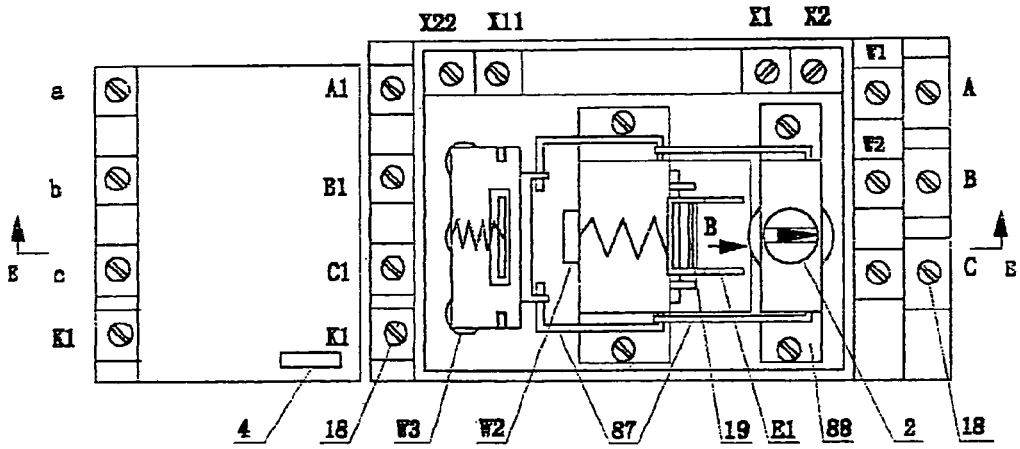
FIG. 10 is a top view showing the structure of the vertical bolt switch.
Figure 11:
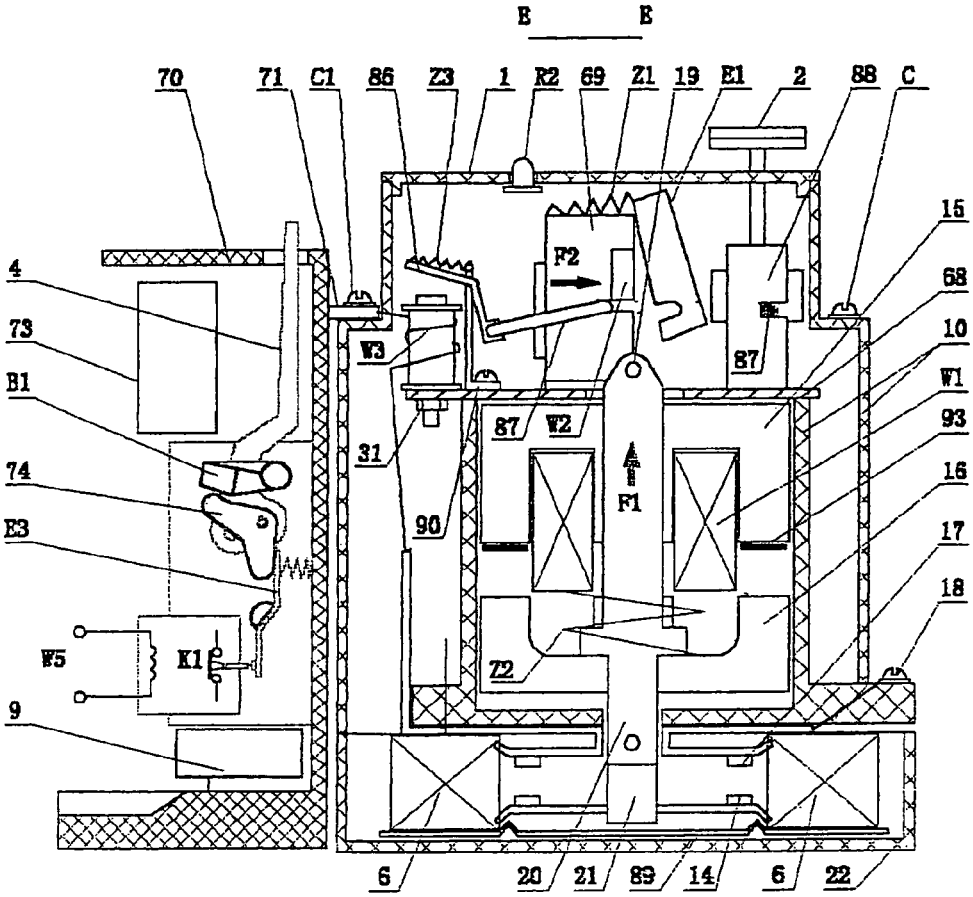
FIG. 11 is a section cross view showing the structure of the pothook switch.
Figure 12:
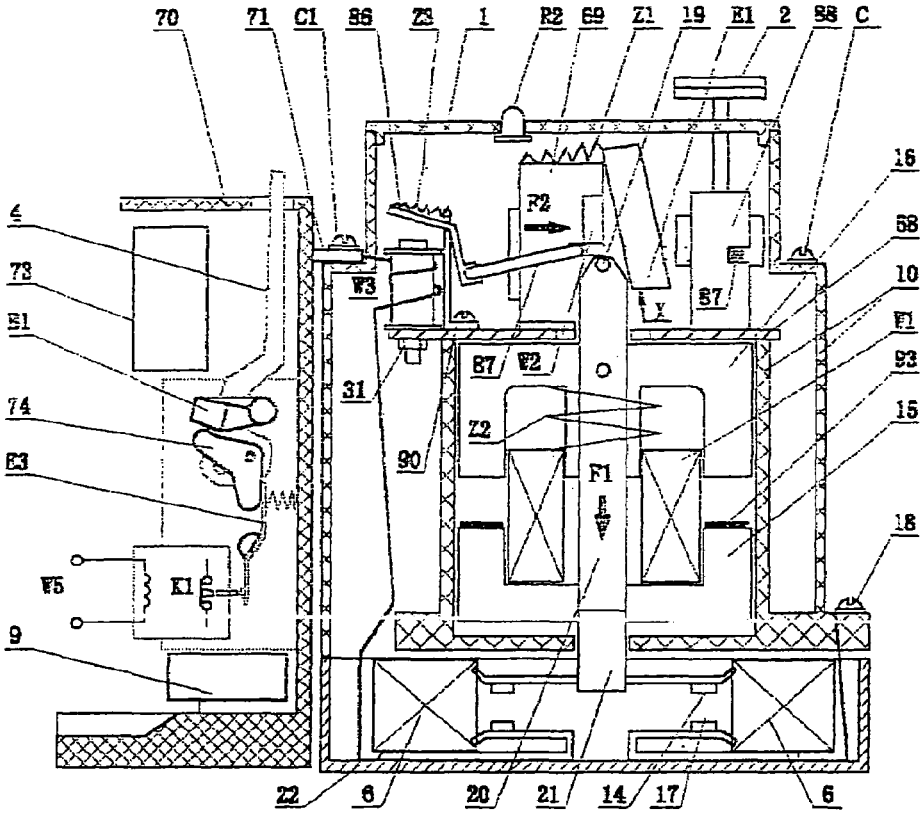
FIG. 12 is a section cross view showing the structure of the baffle switch.

3. The Structure of the Switch Portion of the Electrical Switch (1) The Structure of the Vertical Bolt Electrical Switch FIG. 10 is a top view showing the structure of the vertical bolt switch, including the switch portion and the comprehensive protection portion. The switch portion has a current limiter. FIG. 11 is a section cross view showing the closed state of the switch maintained by the pothook mechanism holding switch; FIG. 12 is a section cross view showing the closed state of the switch maintained by the baffle mechanism holding switch, all of which are applied to the circuit shown as FIG. 1, which will be explained respectively as below.

a. The Contact and Closing Mechanism

The mechanism includes a attracting coil W1, a stationary iron core 15, a stationary contact 17, a movable contact 14, a guiding arc slice 89 and a arc extinguisher 6, in which the contact mechanism uses a repulsion force type. The movable iron core 16 and the movable bolt 19 are connected together with the connection board 20, the insulting connection frame 21 and the movable contact 14.

While the coil W1 is powered on, the movable iron core 16 is attracted to make the movable contact 14, the movable bolt 19, the connection board 20 and the insulting connection frame 21 move along the direction shown as F1, therefore, the movable iron core 16 and the movable contact 14 close respectively the stationary iron core and the stationary contact. In the figure, the reference number 93 represents a rubber pad for absorbing shock and reducing the remanence.

b. The Holding Mechanism

The holding mechanism is one of the features of the present invention, it employs a pothook or baffle E1 to make the switch closed by means of hitching or ramming the movable bolt 19. The holding mechanism may be placed in the different positions corresponding to the movable bolt 19, and it has several various structures such as an electromagnetic holding mechanism, an elastic holding mechanism and a pushing block holding mechanism etc according to the different holding modes. W1, W2, and W3 represent the electromagnetic irons including the iron core and the coil, all of which are indicated by the coil or W1, W2 and W3 throughout the accompanying drawings.

Figure 14:
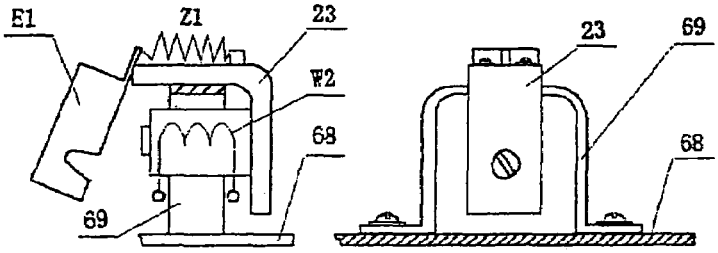
FIG. 14 is a view schematically showing the structure of the holding mechanism shown in FIG. 11.
Figure 15:
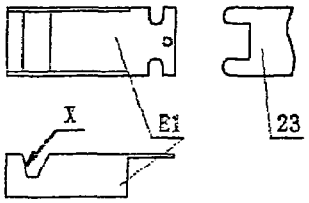
FIG. 15 is a view schematically showing the structure of the pothook show in FIG. 11.

The electromagnetic holding mechanism includes W2 and the relevant elements inside the shield W2 in the FIG. 1, comprising the pothook or baffle E1, the movable bolt 19, a magnet conducting plate 23, a bracket 69 and a tension spring Z1, as shown FIG. 14. FIG. 15 is a view schematically showing the structure of the pothook E1, and also showing the structure of the intersection of the top end of the magnet conducting plate 23 and the pothook E1, in which the surface X on the pothook E1 is an inclined plane, that is to say, an included angle is formed between the surface x and the direction F1, it is advantageous to make the pothook E1 disconnect with the movable bolt 19.

When the coil W2 is powered on, the pothook E1 is attracted to hitch or ram the movable bolt 19 so as to make the switch closed.

Figure 13:
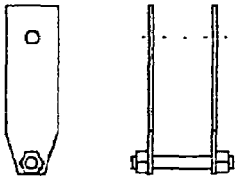
FIG. 13 is a view schematically showing the structure of the movable bolt shown in FIG. 11 and FIG. 12.
Figure 17:
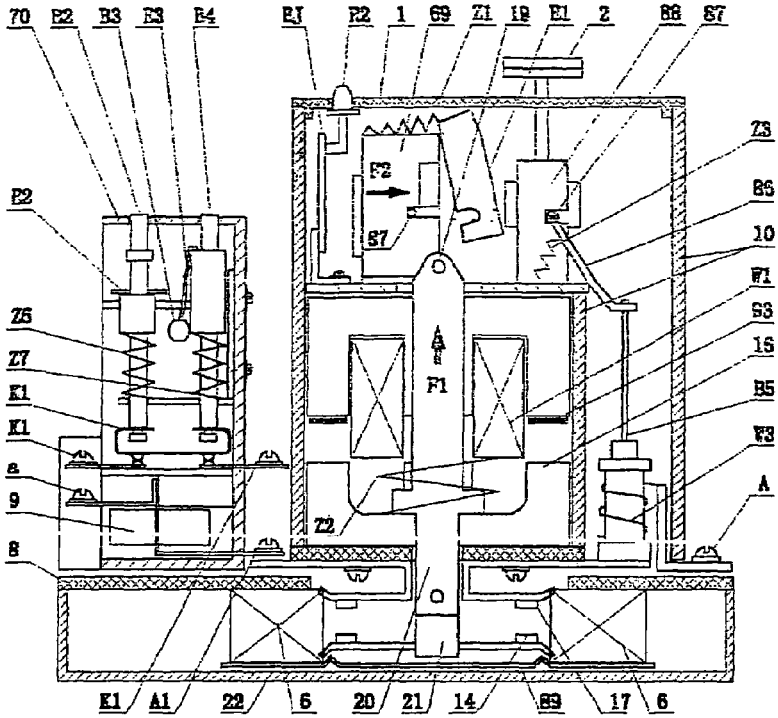
FIG. 17 is a section cross view showing the structure of the electrical switch implemented according to the present invention.
Figure 21:
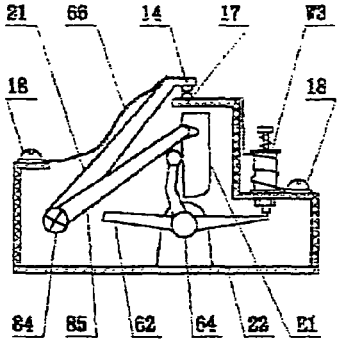
FIG. 21 is a view schematically showing the structure of the single contact side hook type electrical switch.
Figure 20:
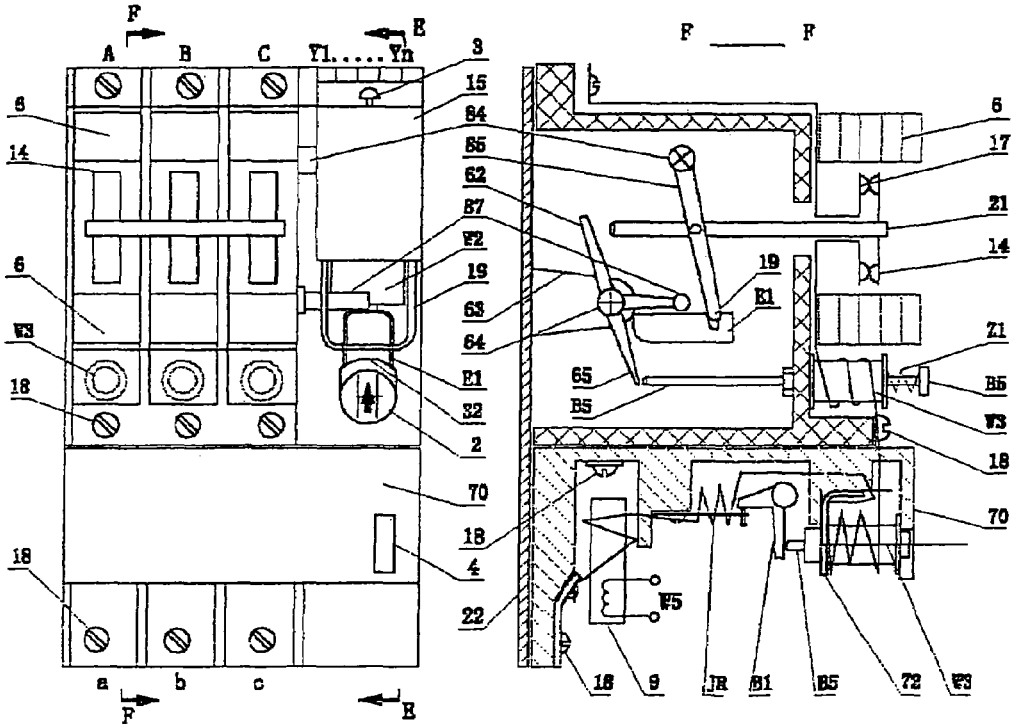
FIG. 20 is a top view and cross section view showing the structure of the side hook type electrical switch, respectively.
Figure 43:
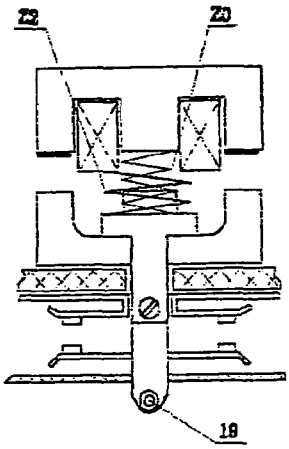
FIG. 43 is a view schematically showing the structure of another switch in which the movable iron core has separated from the movable bolt.

The movable bolt 19 is one of the features of the present invention, and is one part of the holding mechanism, it may be attached to the iron core end on which the iron core intersect with the contact vertically, as shown FIGS. 11 and 17, also may be attached to the contact end as shown FIG. 43, further may be attached to the iron core end on which the iron core is parallel with the contact as shown FIGS. 20 and 21, or be fixed on the other position where it can connect the switch, FIG. 13 is a view schematically showing the structure of the movable bolt 19.

c. The Current Limiting Mechanism and the Over-Current Trip of the Switch

The current limiting mechanism is one of the features of the present invention, it is connected in serial in the main loop circuit. Since its action is direct and easy, and the intrinsic time is very short, the capacity of breaking the expected short circuit current is high.

Figure 16:
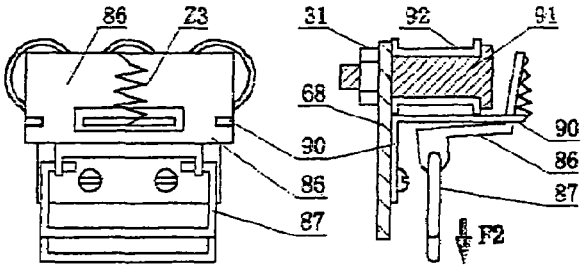
FIG. 16 is a view schematically showing the structure of the limiting current mechanism shown in FIG. 11 and FIG. 12.

The limiting current mechanism is comprised of a coil W3, a tension spring Z3, a pushing plate 86, a pushing bar 87 and a bracket 90, as shown FIG. 16. In the figure, the reference number 91 represents the coil core, the reference number 92 represents the coil insulting case, in which the coil wire is wound outside the case.

The coil W3 is connected in serial in the main loop circuit as a current limiting mechanism, when an over-current occurs in the switch (the over-current is preferably as 12 to 16 times as that of its rated current), the pushing plate 86 is attracted to push the pushing bar 87 to move along the direction F2, the pushing bar 87 pushes the pothook E1 to make it disconnect with the movable bolt 19, such that the switch is tripped off. At this time, the pushing bar 87 disconnects with the duplex ring 27 on the other pushing block of the switch, the spring Z5 can make the turnbutton 2 and the elements connected in serial on the duplex ring 27 jump up along the direction F3 until the bracket 88 can block the pad 33. At this time, the movable contacts d1 and d2 separate from the stationary contacts f1, f2, f3 and f4, thereby turning off the power supply of the switch, meanwhile, as shown 4(*b*), it is clear for at a glance that the turnbutton 2 is apparently high.

If it needs to reset, the turnbutton 2 is pressed. At this time, the duplex ring 27 is lower than the pushing bar 87, the pushing bar 87 will be return back due to the tension force of the tension spring Z3, and block the duplex ring 27 to restore the switch to operate normally.

d. Connection Supporting Mechanism

The connection supporting mechanism includes a case 1, an end cover 8, a housing 10, a base 22, a bedplate 68 and various connection fixing members etc.

As shown FIGS. 11 and 12, there is provided with several chambers separating from each other on the base 22, each of which can fix two sets of arc extinguishers and one arc guiding plate, and receive a set of stationary and movable contacts. The base 22 is attached to the housing 10 by a fixing member, on which there is a mounting hole and a mounting slot for installing and fixing the switch.

There is a selective switch, a current limiting mechanism and a holding mechanism on the bedplate 68, on the middle of which has a hole through which the movable bolt 19 can pass. On the assembling, the movable iron core 16, the connection board 20 and the insulting connection frame 21 are first installed, then the tension spring Z2, the coil W1 and the stationary iron core 15, at last the bedplate 68 for fixing the various members is installed, and fixed by the fixing member, as shown FIGS. 10, 11 and 12.

(2) The Other Structure Switch

FIG. 17 is the structure of a switch in which the switch portion includes a current limiting mechanism, and the positions of the comprehensive protector and the current limiting mechanism are different from that of the aforesaid, but the operation is on the same principle.

Figure 18:
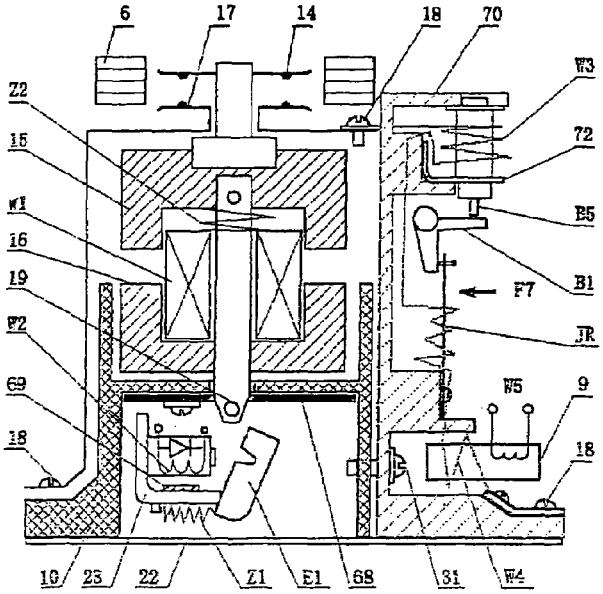
FIG. 18 is a view schematically showing the structure of the switch in which the contact is positioned on its top end.
Figure 18A:
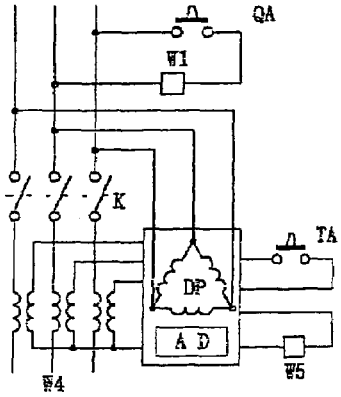

FIG. 18 is a view schematically showing the structure of the electrical switch in which the contact is positioned on its top end.

Figure 19:
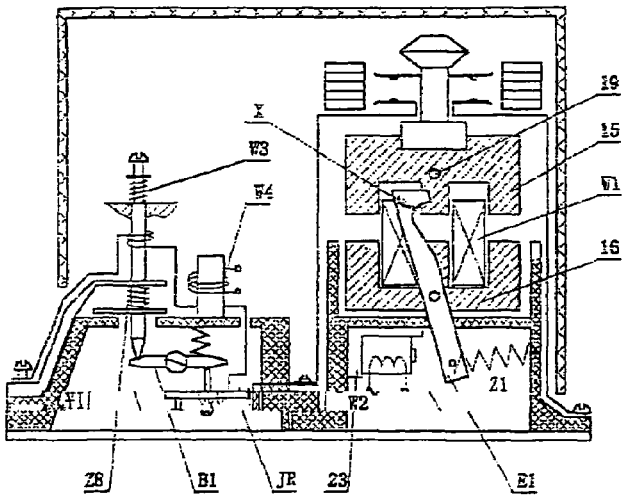
FIG. 19 is a view schematically showing the structure of the nonselective switch in which the contact is positioned on its top end.

FIG. 19 is a view schematically showing the structure of the electrical switch in which the contact is positioned on its top end and the pothook is different from that of the mentioned above. There is not selective switch in the FIGS. 18 and 19, which employ the electrical circuit shown as FIG. 2.

(3) The Side Pothook Electrical Switch

The attracting coil, the movable coil, the stationary iron core and the contact mechanism in said switch are connected in serial on one line, generally called a direct motion type, the present invention mainly introduces a switch in which the attracting mechanism, the tripping mechanism and the contact mechanism are installed in parallel, also called rotation type, and the structure is similar to the CJ10-60 contactor.

Figure 22:
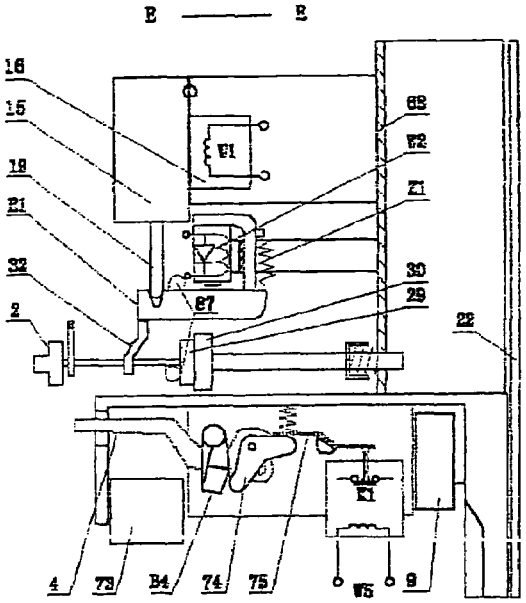
FIG. 22 is a cross section view showing the structure of the side hook type electrical switch shown in FIG. 20.
Figure 23:
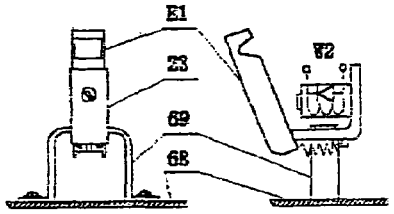
FIG. 23 is a view schematically showing the structure of the holding mechanism of the side hook type electrical switch shown in FIG. 20 and FIG. 22.

FIG. 20 is a top view showing the structure of the switch including a comprehensive protector in which the housing is separated and a cross section view taken along line F-F, FIG. 22 is a cross section view taken along line E-E, in which the connecting shaft 84 and the connecting rod 85 are connected with the movable iron core and the movable contact to make them result in linkage. The selective switch and the comprehensive protector in the switch have the same structure and operational principle as the vertical bolt switch, only have different positions, the combination of the position may have various forms if needed, whose description will be omitted herein. As shown FIG. 23, the pothook switch and the vertical bolt switch are just opposite.

Figure 24:
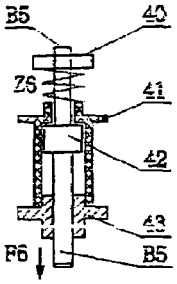
FIG. 24 is a view schematically showing the structure of one current limiter shown as FIG. 20.
Figure 25:
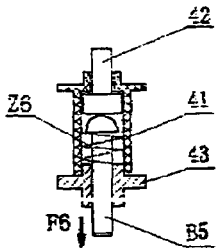
FIG. 25 is a view schematically showing the structure of another current limiter shown as FIG. 20.

As shown FIG. 20, there are two current limiters W3, one of which is to restrain the limit short circuit current in the switch, it has many different structures, as shown FIGS. 24 and 25. In the figures, the reference number 40 represents a adjusting screw nut, the reference number 41 represents an insulting case, the reference number 42 represents an iron prop, the reference number 43 represents an iron core, B5 represents a pushing bar made of nonferromagnetic material, the wire is wound outside the insulting case 41.

When the over-current occurs in the switch, the iron prop 42 will be attracted to move along the direction F6 so that the pushing bar B5 also can move along the direction F6.

In the FIG. 20, the rotating shaft 64 has three rows of cogs, in which the number of cog 65 is three, each of cog corresponds to the pushing bar B5 on the current limiter W3 of each phase power supply, the number of the cog 87 is one, which corresponds to the pothook E1, the cog 62 corresponds to the insulting connection frame 21.

When the over-current occurs in the switch, the coil W3 attracts the pushing bar B5 so that it can push the cog 65 to make the rotating shaft 64 rotate so as to make the cog 87 push the pothook E1, which can trip off the movable bolt 19 resulting in the tripping of the switch, at this time, the cog 87 separates from the movable slide slice 29, and the switch trips off so as to switch off its power supply, in addition, the cog 62 strikes the connection frame 21 to increase the breaking speed of the switch.

Some of side pothook type switches have single contact structure, as shown FIG. 21, whose contact is directly fitted on the connection frame 21, and connected with the wire terminal 18 through the flexible wire 66, the tail ends of the connection frame 21 and the connection bar 85 are provided on the connecting shaft 84, which can rotate at the axle center of the shaft 84, and have the same operational principle as the mentioned above.

Figure 3:
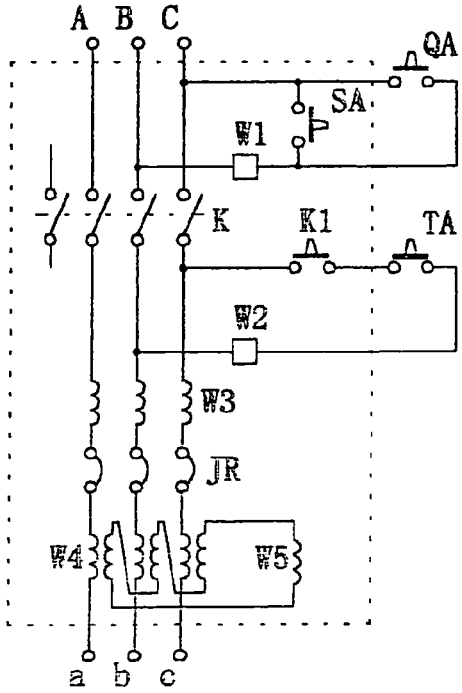
FIG. 3 is a view showing the circuit diagram of a resilience-holding electrical switch with electrical actuation.
Figure 26:
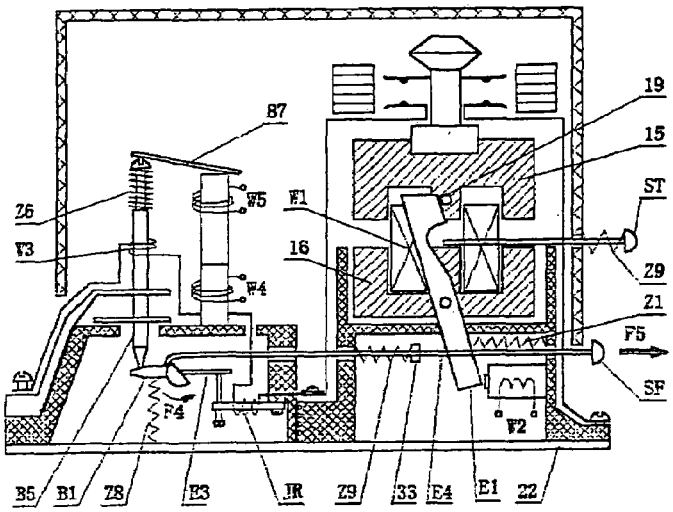
FIG. 26 is a view schematically showing the structure of the resilience-holding mechanical switch with electrical actuation.

(4) The Switch Starting-Up with Electrical Power and Holding with the Elasticity FIG. 26 is a view schematically showing the structure of the switch turning on or off with electrical power and with resilience-holding, which employs the circuit shown as FIG. 3.

In the Figure, Z1, Z6, Z8 and Z9 are all springs, ST represents a manual stop button, SF represents a manual reset button, JR represents an overload action member, E3 represents a temperature compensating plate, the other elements have been introduced above. When the switch is turned off, the movable bolt 19 is applied on the pothook E1. When the coil W1 is powered on, the switch is closed, the movable bolt 19 is fallen into the hook of the pothook E1, the tension spring pushes against the pothook E1 to make it hitch the movable bolt 19 such that the switch keeps closed. When it is needed to turn off the switch, the manual stop button ST is pressed down to make the coil W2 be powered on so that the switch can be electrically turned off, the manual stop button ST is pressed down so that the switch can be manually turned off.

When an over-current, an overload and a phase failure occurs in the switch, it can make the connecting shaft B1 rotate in the direction F4 such that it can prevent the connecting shaft B1 from blocking E1 to move along the direction F5, and the pad 33 strikes the pothook E1 to make it trip off the movable bolt 19, resulting in the tripping of the switch, when it resets, the manual reset button ST is pressed down to turn off the switch.

Figure 27:
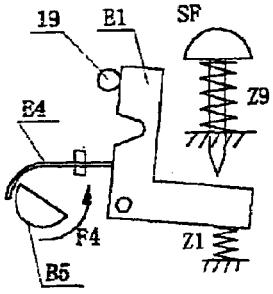
FIG. 27 is a view schematically showing the pothook coupled with the movable bolt in the resilience-holding switch.

All mentioned above switches may be changed into the resilience-holding switch, whose operational principle of the pothook and the movable bolt is shown as FIG. 27.

Accordingly, the switch portion of said switch have many forms of the combination, it has an electromagnetic holding type, an elastic holding type and a pushing-shielding holding type depending on different holding modes, it has a selective or nonselective type depending on whether there is a selection switch, and it has a switch with current limiter and a switch with no current limiter depending on whether there is a current limiter, which will not be illustrated individually herein.

3. The Comprehensive Protector

There are many kinds of different comprehensive protectors, it will be described several typical structures below.

(1) The Electromechanical Type -I

Figure 29:
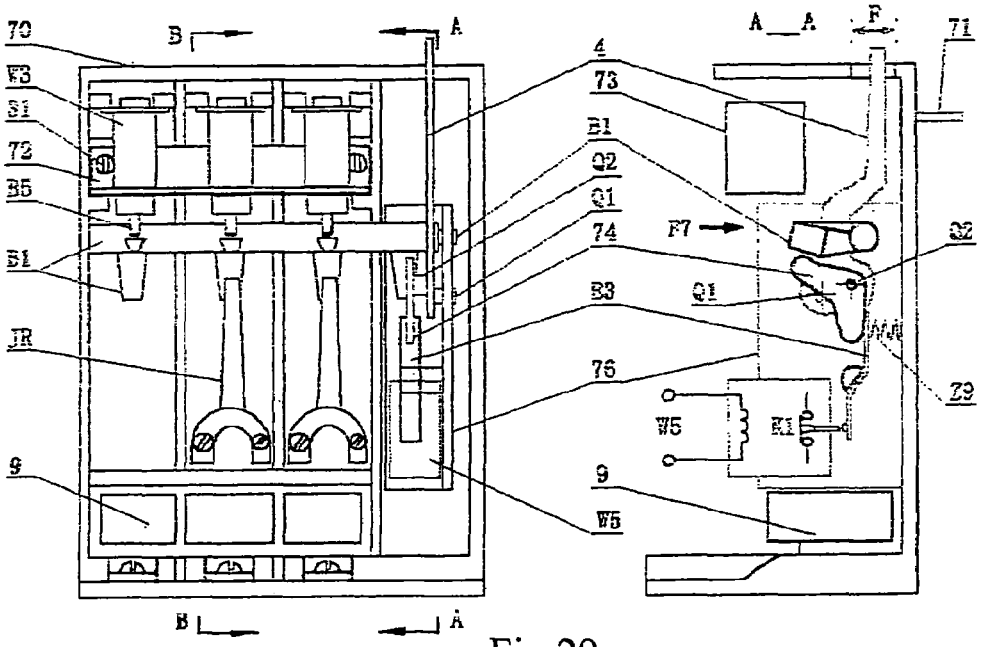
FIG. 29 is a view schematically showing the structure of one mechanical-electrical protector.

FIG. 29 is a front view showing the structure of the protector in which the housing is separated and a cross section view taken along line A-A, FIGS. 11 and 12 are views schematically showing the switch combing with the cross section taken along line A-A, FIGS. 18 and 20 are views schematically showing the switch combing with the cross section taken along line B-B. The protector in FIG. 29 has the functions of over-current, overload and phase failure protection. W3 represents an over-current element, which may be made as shown FIG. 24 or FIG. 25, JR represents a thermal protection element, which can be bent toward the direction F7 due to heat. The reference number 4 represents an overload adjusting bar, which can rotate at the axle center Q1, and adjust the overload current in the range of F. The connecting shaft B1, the overload adjusting bar 4, the coil W5 and the pushing plate 74 are fixed through the bracket 76, and installed in the housing 70.

Figure 28:
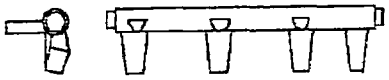
FIG. 28 is a view showing the shape of the connecting shaft in the switch shown as FIG. 26.

The over-current element W3 is inserted in the connecting plate 72, which is fixed in the housing 70, the pushing bar B5 is close to the connecting shaft B1, as to the three-phase load, the shape of the connecting shaft B1 is shown as FIG. 28, it has two lines of cogs, in which three of cogs in the row correspond to the pushing bar B5 of the over-current element W3, three of four cogs in the column correspond to the thermal protection element JR, the other cog corresponds to the pushing plate 74, the pushing plate 74 is fixed on the overload adjusting bar 4 at the axle center Q2, when the over-current or overload occurs in the switch, the pushing plate 74 pushes the compensating plate E3 to make the connecting shaft B1 rotate, the connecting shaft B1 pushes the pushing plate 74 to make it push down the temperature compensating plate E3 such that the temperature compensating plate E3 can impel the switch K1 to be turned off, resulting in the tripping of the switch.

Figure 33:
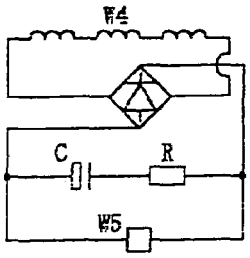
FIG. 33 is a view showing the phase failure control circuit of the protector shown in FIG. 29.

As shown FIG. 29, the switch K1 and the coil W5 are preferably small-size relay, whose normally closed contacts are the switch K1, the coil W5, the coil W4 and the iron core 9 comprise a phase failure control circuit, as shown FIG. 33. Each phase of the coil W4 has a structure which employs a single iron core, and an output from a single coil, in which three-phase coils are connected in serial with each other, and whose output is rectified, filtered and then inputted into the coil W5. If the three-phase electrical sources are balanced and powered on, the output from the coil W4 is zero. If the phase failure occurs, then an output is produced so that the switch K1 is attracted by the coil W5. The action value of the coil W5 is selected according to the rated current, in which there exists an unbalance 20% of the three-phase electrical sources, that is, it allows the coil W4 to output 20% of the rated current, but the coil W5 may not act for a long time.

(2) The Electromechanical Type -II

Figure 30:
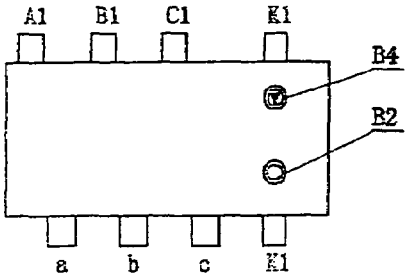
FIG. 30 is a view schematically showing the structure of another one mechanical-electrical protector.

FIG. 30 is a front view showing the structure of the protector and a cross section view taken along line A-A, FIG. 17 is a view schematically showing the protector combing with the switch, the protector has the functions of a overload and a phase failure protection, in the figure, R2 represents an operational lamp.

Figure 32:
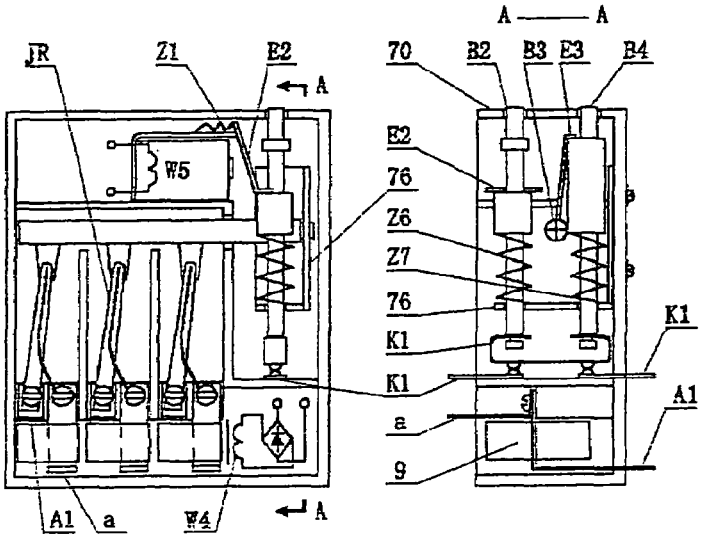
FIG. 32 is a view showing a state after the over-current occurs in the protector shown in FIG. 30.
Figure 32:
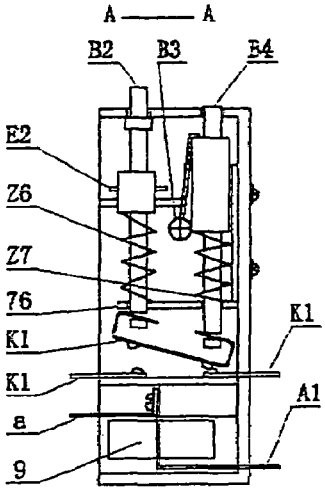
Figure 31:
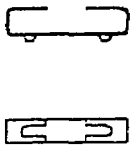
FIG. 31 is a view schematically showing the structure of the contact of the mechanical-electrical protector shown in FIG. 30.

In FIG. 30, the phase failure action mechanism is comprised of an over-current bar B2, a spring Z6, a tension spring Z1, a shield E2, the coil W4 and the coil W5. When the phase failure occurs in the switch, the coil W5 attracts the shield E2 to make it drop out of the over-current bar B2, then the over-current bar B2 is ejected due to the elastic force of the spring Z6 to drive the switch K1 to break the contact. As shown FIG. 31, the switch K1 is an elastic copper sheet, on which there are two semicircle contacts. After the over-current bar B2 springs up, it is apparent to be higher on the surface of the protector, as shown FIG. 32, if it needs to reset, the over-current bar B2 is only pressed down.

Figure 34:
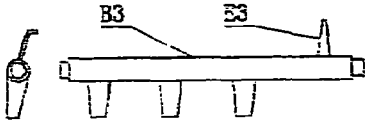
FIG. 34 is a view schematically showing the structure of the connecting shaft and compensation slice in the protector shown in FIG. 30.
Figure 35:
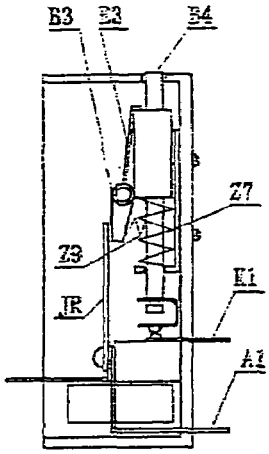
FIG. 35 is a view schematically showing the element in assembly of the protector shown in FIG. 30.
Figure 36:
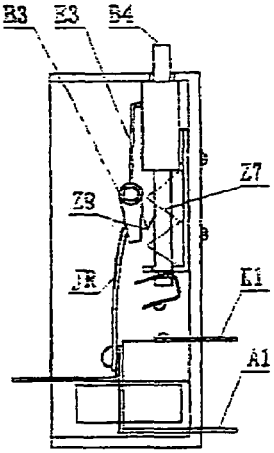
FIG. 36 is a view schematically showing a state after the tripper shown in FIG. 30 is tripped.

In the FIG. 30, the overload action mechanism is comprised of the overload bar B4, the connecting shaft B3, a compensating sheet E3, a thermal element JR and a spring Z7. As shown FIG. 34, the connecting shaft B3 and the compensating sheet E3 have three cogs in one line, each of which corresponds to the overload element in each phase, the front end of the compensating sheet E3 is formed into a pothook which can hook the overload bar B4, the rear end of the compensating gauge E3 is clamped in the connecting shaft B3 whose two ends are cylinders for fixing and rotating, a spring Z9 pushes against the connecting shaft B3 to make it hook firmly the overload bar B4, the thermal element JR in each phase sticks to the cogs of the connecting shaft B3, as shown FIG. 35, when the thermal element JR can be bent due to the heat to make the connecting shaft B3 rotate, such that the compensating a sheet E3 can drop out of the overload bar B4, the overload bar B4 springs up to break the switch K1, it is apparent to be higher on the surface of the protector, as shown FIG. 36, if it needs to reset, the overload bar B2 is only pressed down. The compensating gauge E3 is to compensate the temperature of the thermal protection.

Figure 37:
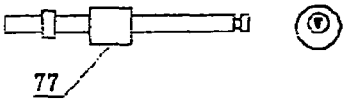
FIG. 37 is a view schematically showing the structure of the overload bar in the protector shown in FIG. 30.
Figure 38:
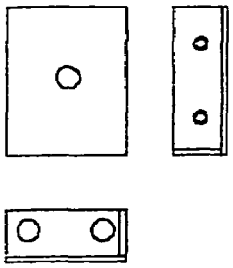
FIG. 38 is a view schematically showing the structure of the bracket in the protector shown in FIG. 30.

In order to adjust the over-current, the platform 77 on the overload bar is formed into an eccentric circular, whose radius from the lower point to the high point is selected according to the degree of curve of the thermal element on which the current is applied, FIG. 37 is a view showing the structure of the overload bar and the platform 77, FIG. 38 is a view showing the structure of the bracket 76, which can fix the over-current bar B2, the connecting shaft B3 and the overload bar B4.

(3) The Mechanical Releasing Type

FIG. 26 is a view schematically showing the structure of the mechanical releasing electrical switch, the left side in the figure is a comprehensive protector, whose structure and principle have been described above, and will be omitted herein.

(4) The Electrical Releasing Type

FIG. 18(*a*) is a view showing the circuit diagram of the structure of the electronic releasing comprehensive protector, in which the coil W4 is a mutual inductor for detecting the current of the main loop circuit, DP is a transformer of the electrical source, AD is an electronic controller, which may be an integrated circuit or use directly a single chip processor. The operation of the electronic comprehensive protector is varied with the current detected on the W4, it is determined whether there exists an over-current, an overload and a phase failure by comparing the loads, and it is further determined whether the protector needs to be released based on the result of the comparison.

The controller employing the single chip processor may be designed to have various functions, such as displaying each phase current and voltage of the controlled load, and displaying the environment temperature, moisture, time and the total number of starting-up, it may record the phase current, voltage or phase sequence of the phase failure of the controlled load before the releasing when the over-current, the overload or the phase failure occurs every time, it also may use an audible and visual alarm.

The electronic protector may be integrated with the electromechanical protector, thereby forming a comprehensive protector, that is to say, the comprehensive protector has either the electromechanical structure and function, or the electronic structure and function, in FIG. 29, the reference number represents an electronic controller.

4. The Operation of the Electrical Switch

The operation of the electrical switch may be illustrated by the drawings above, now it is taken as an example by FIGS. 11, 12 and 17.

When the selective switch directs to the remote control position D1, the switch K2 and K3 are turned on, at this time, the switch may be operated remotely by a button. If the button QA is switched on, the coil W1 is powered on, and the switch is attracted to be closed, at this time, the movable contact 14, the movable iron core 16, the movable bolt 19, the connecting plate 20 and the insulting connection frame 21 can move along the direction F1, the switch can be closed, the movable contact 14 and the stationary contact 17 are connected, the coil W2 is powered on immediately so that the pothook E1 can be attracted and closed, thereby resulting in the movable bolt 19 being locked by the pothook E1. At this time, although the coil W1 is powered off, the coil W2 is powered on to make the pothook E1 hook the movable bolt 19 so as to keep the switch closed. If it needs to break the switch, the switch TA is opened to make the coil W2 be powered off, so that the pothook E1 is not attracted to disconnect with the movable bolt 19 because the component force is produced on the inclined surface X of the pothook E1 due to the tension force of the tension spring Z1 applied on the pothook E1 and the pressure applied on the movable bolt 19 by the spring 22, after the pothook E1 dripping out of the movable bolt 19, the movable contact 14, the movable iron core 16, the movable bolt 19, the connecting plate 20 and the insulting connection frame 21 can move along the direction opposite to the direction F1, therefore, the switch can be broken.

When the selective switch directs to the stop position D2, no matter what operation the switch was, the switch is broken, and the remote control is out of work.

When the selective switch directs to the direct connection position D3, the switch is switched on immediately.

When the selective switch directs from the direct connection position D3 to the direct connection locking position D4, the pushing block 32 firstly pushes against the pothook E1, then the switch K2 and SA are turned off, the switch can be closed by the pushing block 32 pushing against the pothook E1, thereby forming a pushing block holding type switch. When the switch needs to be stopped on the position D4, it is only returned back to the position D2.

When the switch is closed on the position D1 or D3, if the overload or the phase failure occurs, the contact K1 in the comprehensive protector will be disconnected to make the coil W2 be powered off, such that the switch can be broken. Only when the comprehensive protector is reset, the switch will operate normally. If the over-current occurs in the switch, it will be happen as described above, which will be omitted herein.

When the over-current occurs in the switch on the position D4, since the pushing block 32 is made of elastic material, the pushing bar 87 may compress the pushing block 32 to disconnect the pothook E1 such that the pothook E1 can release from the movable bolt 19, thereby resulting in the switch tripping out.

Figure 46:
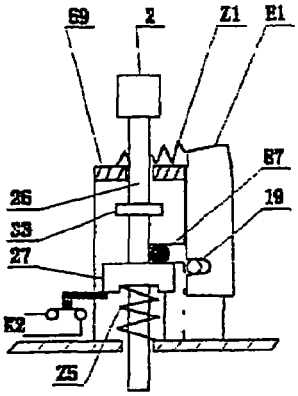
FIG. 46 is a view schematically showing a state in which the nonselective switch indicates the over-current and breaks away, the reset mechanism resets.
Figure 45:
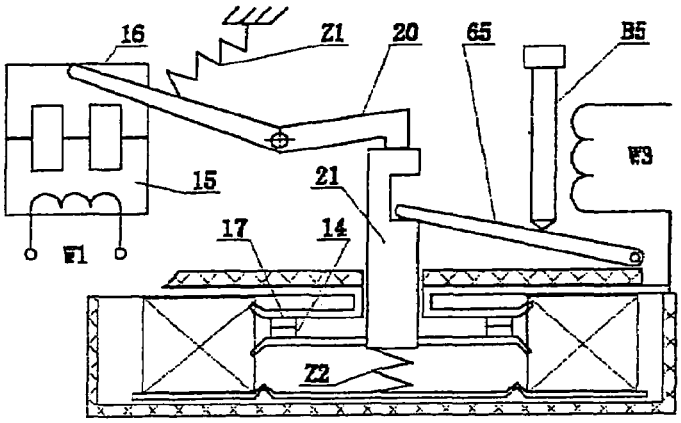
FIG. 45 is a principle diagram showing the structure of the switch produced by TE Company.
Figure 47:
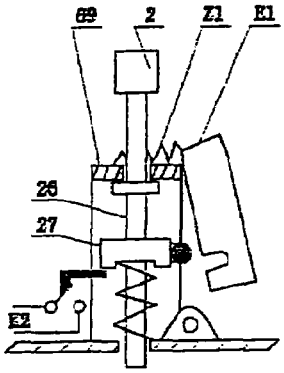
FIG. 47 is a view schematically showing a state in which the nonselective switch indicates the over-current and breaks away, the reset mechanism feedbacks.
Figure 48:
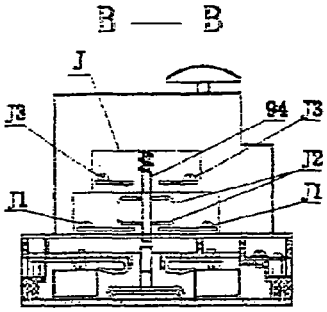
FIG. 48 is a front view showing the switch according to one preferred embodiment of the present invention, on which the assistant contact is disposed.
Figure 49:
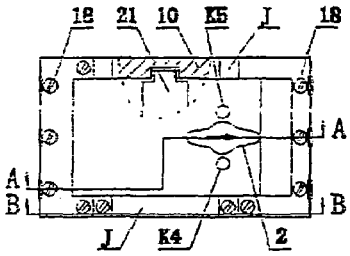
FIG. 49 is a top view showing the switch shown in FIG. 48, in which it has the assistant contact and the slide way.

As to the nonselective switch, there is provided with a mechanism for over-current displaying, analyzing and resetting on the bracket 69, which can control the switch K2 shown as FIG. 2. FIG. 46 is a view showing the structure of the mechanism which is on the closed state. In the figure, the bar 26 is a cylinder with a bowl-shaped duplex ring 27 in the middle of it, the switch K2 is a normal open button, Z5 is a spring, the reference number 69 is a bracket. When it operates normally, the pushing bar 87 presses against the duplex ring 27, the switch K2 is turned on, when the over-current occurs in the switch, the pushing bar 87 can disconnect from the bar 26, thereby the bar 26 can spring up to make the switch K2 be turned off, as shown FIG. 47. Only when the bar is reset, the switch can operate normally.

The Measures Improving the Performance of the Switch

Figure 39:
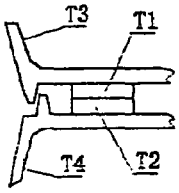
FIG. 39 is a view schematically showing the structure of the movable arc contact.

1. Making Use of the Movable Arc Contact to Prolong the Life Span of the Contact FIG. 39 is a view schematically showing the structure of the movable arc contact, in which T1 is a movable contact, T2 is a stationary contact, T3 is a movable contacting sheet, T4 is a stationary contacting sheet. As is well known, when two charged bodies are close to each other, the electric charges will be discharged from the top end nearby. The movable arc contact makes use of the principle to make the electric arc be discharged from the contact position to the other position, then the electric arc can be entered into the arc extinguisher.

2. Changing the Contact Shape to Increase the Contacting Area of the Contact

Figure 40:
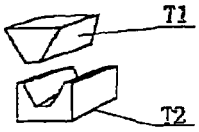
FIG. 40 is a view schematically showing the structure of the V-shaped contact.

The contact is designed to form a V-shape, as shown FIG. 40, compared with the semicircle or plane contact in the prior art, the contacting area of the contact can be increased, and the contacting resistance can be reduced.

3. The Fuse Provided in the Switch to Limit the Maximum Short Circuit Current

Figure 41:
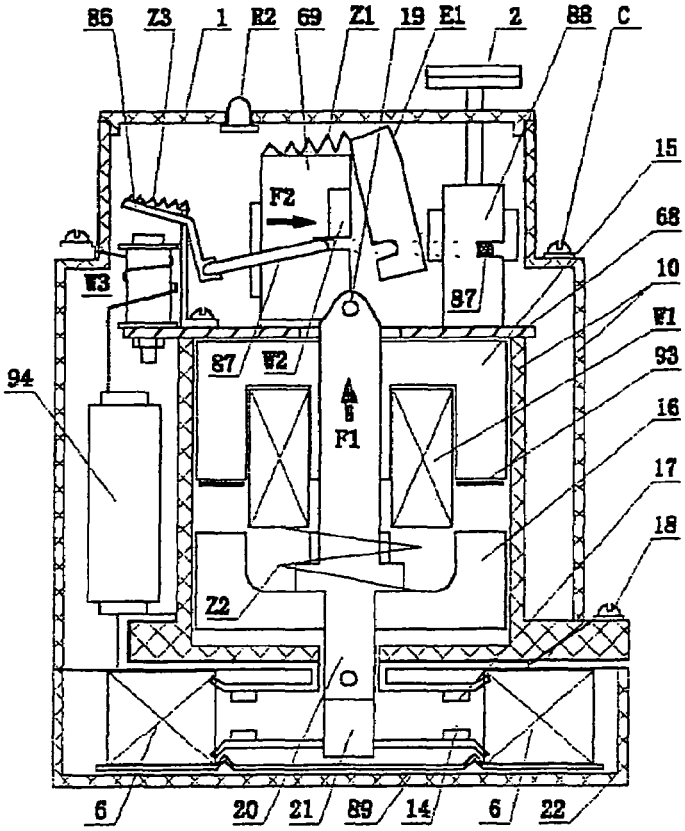
FIG. 41 is a view schematically showing the structure of the switch with a protective fuse.

As shown FIG. 41, a fuse 94 is added in each phase main electrical circuit to limit the maximum short circuit current.

4. Adding the Releasing Circuit of the Coil or Employing Twin Coil.

Figure 42:
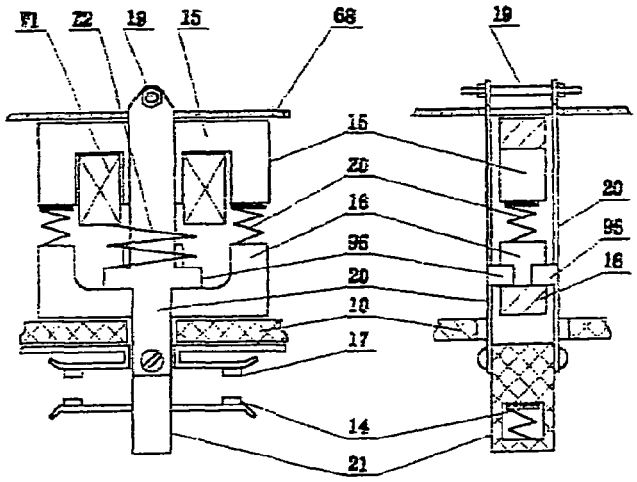
FIG. 42 is a view schematically showing the structure of one switch in which the movable iron core has separated from the movable bolt.

5. The Iron Core Disconnecting from the Movable Bolt to Increase the Breaking Speed In order to increase the breaking speed of the switch, the switch can break the movable iron core from the movable bolt to lighten the weight of the movable bolt in breaking, such that the breaking speed can be increased. FIG. 42 is a view schematically showing the structures of the movable iron core and the movable bolt, in which the movable bolt 19, the connecting plate 20, the insulting connection frame 21 and the movable contact 14 are connected together. Two connecting plates on which a pair of hooks 96 are provided define a space in which the movable bolt 19 is formed. when the coil W1 is powered on, the movable iron coil 16 is attracted because the hooks 96 hook the movable iron coil 16 to allow it to drive the movable bolt 19 and movable contact 14 to close together. When the coil W2 is powered, the pothook E1 hooks the movable bolt 19 to close the switch. When the coil W1 is powered off, the movable iron is pushed to its original position by the spring Z0, the movable iron coil 16, the movable contact 14 and the movable bolt 19 are then separated. If the switch is dropped out, the movable contact will be broken at lower weight and a higher speed thereby improving the short-breaking capacity of the switch.

FIG. 42 is a view schematically showing the structures of the movable iron core and the movable bolt employing two release springs, FIG. 43 is a view schematically showing the structures of the movable iron core and the movable bolt employing one release spring.

6. Making Use of the Over-Current Percussion Arrangement Mechanism to Increase the Breaking Speed The present invention is designed to make use of the energy produced by the over-current in the switch to strike the movable bolt, thereby improving the breaking speed.

FIG. 20 is one of said structures, whose operational principle has been described above.

Figure 44:
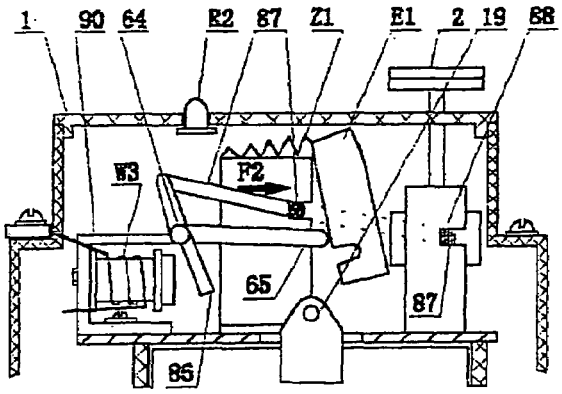
FIG. 44 is a view schematically showing the structure of the impacting switch.

Said switch stated above may be changed into a percussion type switch, as shown FIG. 44, the coil W3 is a horizontal type, the connecting shaft 64, the pushing bar 87, the striking bar 65 and the attracting iron 86 are integrated. When the over-current occurs in the coil W3, the attracting iron 86 is attracted, and the pushing bar 87 pushes the pothook E1 along the direction F1 to make it drop out of the movable bolt 19. At this time, the striking bar 65 strikes the movable bolt 19 to make it be broken at a higher speed, thereby improving the over-current breaking capacity of the switch.

7. Making Use of the Building Block System

The switch can make use of the building block system, if needed, it can be equipped with various additional function, such as a current leakage protection module etc.

8. The Other Kinds of Switch

The switch may be formed into an explosion protection switch or a commutation switch. The contact mechanism or the whole switch only needs to be sealed in the explosion protection switch, or the contacts of the switch are located into the vacuum or the arc extinguishing material.

The present inventor has seen a vacuum direct current contactor in which the attracting coil is bigger, if the holding mechanism according to the present invention is applied into it, the effect of saving energy will be better.

The Description of the Preferred Embodiments of the Electrical Switch

For the purpose of the description of the structure and the function of the electrical switch, there will be described by taking the model machine made by the present inventor as an example.

1. The Structure of the Example of the Switch

FIGS. 48, 49, 50, 51 and 52 are views showing the structure of the example of the switch, in which J represents a normal assistant contact set, whose structure is same as the assistant contacts in the contactor CJXI, in which the shaft 94 has a movable assistant contact, and it can run through, and move up and down in the contact set, Z8 is a spring. When the switch is on the startup, the spring Z8 can make the contact J1 be turned on and the contact J3 be turned off. When the switch is closed, the insulting frame 21 moves up to push the shaft 94 to make the contact J1 be turned off and the contact J3 be turned on. There are two sets of assistant contacts in the switch, in which one of sets is for its use, the other set is for output. The contact sets are embedded into a recess in the middle of two sides of the housing 10, and clamped by the case 1.

Figure 50:
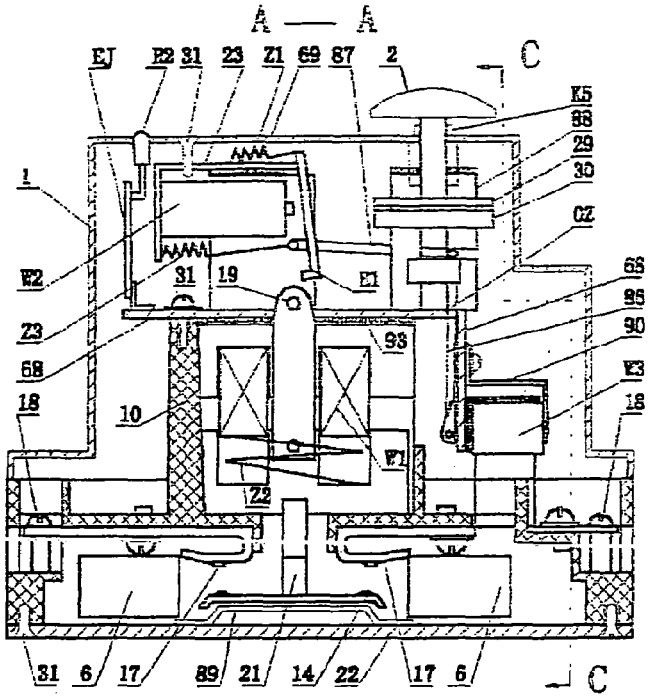
FIG. 50 is a cross section view showing the structure of the switch shown in FIG. 48.
Figure 52:
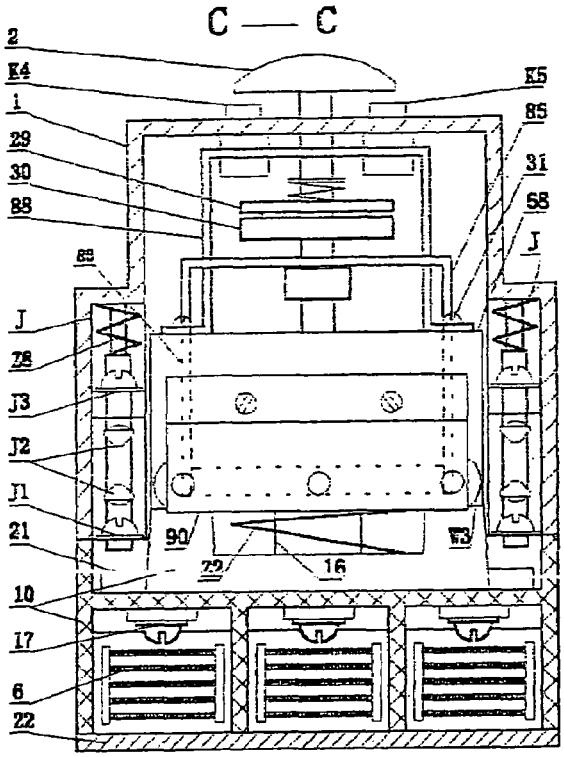
FIG. 52 is a side view showing the switch according to one preferred embodiment of the present invention.
Figure 59:
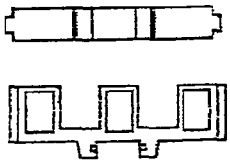
FIG. 59 is a view schematically showing the structure of the insulating bracket.

It is seen from FIGS. 50 and 52 that the switch is fixed and packaged by the base 22, housing 10 and the case 1. There are three chambers in the lower portion of the housing 10, in which the movable contact, the stationary contact, the arc extinguisher and the arc guiding plate are received respectively, there are four pillars on the housing 10, which are in one plane, and can receive the movable iron core, the stationary iron core, the movable bolt, the coil W1 and the base 22, an elongated slot is provided on the middle of the plane which can connect the upper and lower portion, there are slide paths on the sides of the slot, on which the insulting frame 21 can slide, as shown FIG. 49. The insulting frame can support the movable iron core and three sets of movable contacts, as shown FIG. 59, the form of the insulting frame connecting with the movable iron core and the movable contacts are same as that of the contactor CJX2.

The bedplates 68 are fastened on four pillars in the housing 10 by the fastener 31, it has a shape of right angle. The selective switch and the holding mechanism are fastened by the fastener on the bedplate 68, E1 employs a pothook, the movable bolt 19 can pass through a square hole in the middle of the bedplate 68, whose sides can fasten the over-current mechanism by the fastener.

The miniature buttons K4,K5 are fixed on the two holes of the bracket 88, the upper end of the button can pass through the hole on the case 1, and be exposed outside the case 1 for operation.

The simplified electrical switch does not need a selective switch, only the holding mechanism and the over-current mechanism can be remained, the turnbutton 2, the button K4, the button K5, the duplex ring 27, the movable slide slice 29 and the stationary slide slice 30 in FIGS. 50 and 52 are all omitted, only the bracket 88 is left for fixing the attracting iron 86 and the pushing bar 87.

Some electrical switches are simpler, which only keep the holding mechanism. The selective switch and the current limiting mechanism are omitted, the sides of the bedplate 68 are also omitted, some other switches only keep the holding mechanism and the selective switch.

The electrical circuit in the simplified switch is also simple, in which the buttons K2, K3, K4 are all omitted and shorted, the button K5 is omitted and open.

2. The Electrical Circuit and the Control in the Switch

Figure 51:
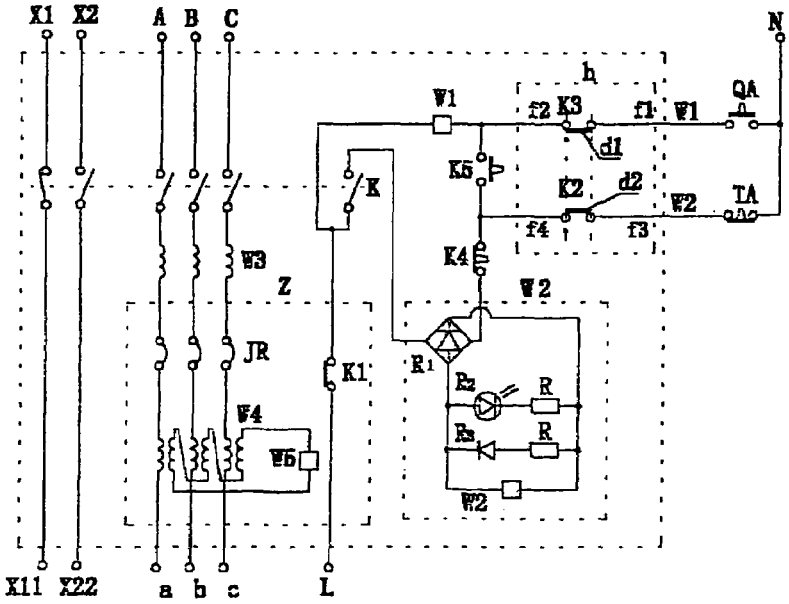
FIG. 51 is a view showing the electrical circuit of the switch shown in FIG. 48.
Figure 53:
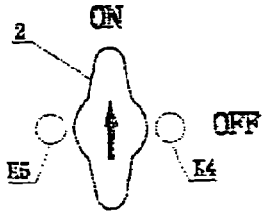

The exemplary switch use the electrical circuit shown as FIG. 51, compared with FIG. 1, which has only a normal open assistant contact, and whose selective switch uses double-position double-switch. When the turnbutton 2 is parallel with the main loop circuit, as shown FIG. 53, the switch is on the control position, which corresponds to the connection position(a) in FIG. 55, at this time, the buttons K2 and K3 in the switch are turned on, the remote control is operated by the buttons QA and TA, the near control is operated by the miniature buttons K4,K5 in the switch.

Figure 54:
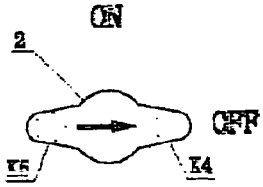
FIG. 54 is a view schematically showing the position of the turnbutton when the switch shown in FIG. 52 is turned off.
Figure 55:
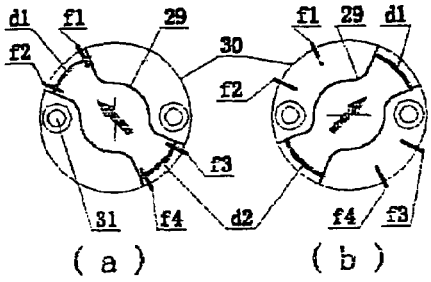
FIG. 55 is a view schematically showing the connection and break of the circuit in the switch shown in FIG. 52.

When the turnbutton 2 is vertical to the main loop circuit, as shown FIG. 54, the switch is on the stop position, which corresponds to the stop position(b) in FIG. 55, at this time, the buttons K2 and K3 in the switch are turned off, the miniature buttons K4,K5 are shield by the turnbutton 2 so that the switch can not be closed.

3. The Over-Current Control in the Switch

Figure 56:
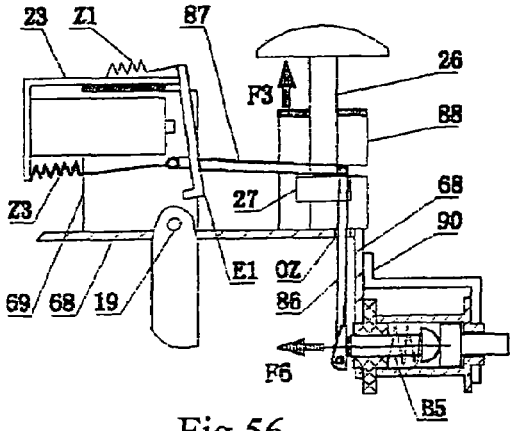
FIG. 56 is a view schematically showing the structure of one current limiter mechanism.
Figure 57:
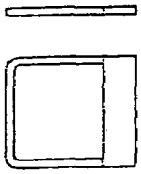
FIG. 57 is a view schematically showing the structure of the attracting iron in the switch shown in FIGS. 48, 49, 50 and 52.
Figure 58:
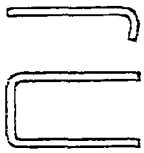
FIG. 58 is a view schematically showing the structure of the pushing bar in the switch shown in FIGS. 48, 49, 50 and 52.

FIG. 56 is a view schematically showing the structure of one current limiter mechanism in the exemplary switch, in the figure, the reference number 86 represents a pushing plate, as shown FIG. 57. 0Z is a rotating fixed pivot of the pushing plate 86, it is located in the slots which are on the sides of the bedplate 68, two sides of the pushing plate 86 are just installed in two slots, the lower side of the pushing plate 86 is a wide side, which corresponds to the pushing bar B5 of the current limiter W3, the top side is a cylinder, which is embedded in two side slots of the bracket 88 to block the turnbutton bar 26. The reference number 87 represents a pushing bar, as shown FIG. 58, whose two front pothooks can hook the cylinder in the top side of the pushing plate 86, the rear shaft is located in two side slots of the bracket 69, the tension spring Z3 is tensioned between the pushing bar 87 and the conducting magnet plate 23.

When the switch is closed, if the pushing bar B5 moves along the direction F6 due to the over-current, it will push the pushing plate 86 to make it rotate at the fixed pivot OZ, and pull the pushing bar 87 to make it push the pothook E1 so that the pothook E1 can drop out of the movable bolt 19, thereby resulting in the tripping of the switch. At this time, the pushing plate 87 separates from the shield of the duplex ring 26 to make it move along the direction F3, thereby leading to the movable and stationary slide slices in the switch separating from each other. After the over-current is relieved, the shield of the duplex ring 26 is pressed to be lower than the pushing plate 86, the tension spring Z3 pulls the pushing plate 86 and the pushing bar 87 to make the system reset.

4. The Assembly of the Exemplary Switch

With reference to the drawings above, the processes in assembling the exemplary switch include: firstly, the movable iron core 16, the connecting board 20 and the insulting frame 21 are assembled together, and inserted into the elongated slot in the housing 10; then, the tension spring Z2, the coil W1 and the stationary iron core 15 are installed; next, the movable bolt 19 is fastened on the connecting board 20. The bedplate 68 to which the holding mechanism, the selective switch and the over-current mechanism are attached is overlapped on the stationary iron core 15, there is a rubber pad 93 provided between the pushing plate 68 and the stationary iron core 15, the pushing plate 68 is fastened by the fastener 31 on four pillars in the housing 10, and the stationary contact 17 is fixed on the housing 10, one end of the coil W3 is fixed by the fastener on the stationary contact 17, and the other end of the coil W3 is fixed on the wiring terminal 18, the movable contact 14 is inserted into the upper end of the insulating frame 21, the arc extinguisher 6 and the arc guiding plate 89 are installed into the chambers in the housing, the base 22 is attached onto the housing 10 by the fastener, and the assistant contact sets are placed the recesses on the two sides in the housing, KJ is fixed on the pushing plate 68, and wired as shown FIG. 51, the housing 10 is fixed on the magnet conducting plate 23, the processes of assembling the switch have been completed.

While the present invention has been described and shown with reference to the preferred embodiments chosen for purpose of illustration, the described above examples and embodiment modes according to the present invention are to be considered in all respects only as illustrative and not as restrictive. It should be apparent that such modifications could be made thereto by those skilled in the art without departing from the scope of the appended claims and the equivalents thereof.

The invention claimed is:

1. An electrical switch for connecting and breaking a circuit, comprising:

a connecting and breaking mechanism to connect and break the circuit provided with at least a set of movable contacts and stationary contacts;

an electromagnetism drive mechanism to control the movable and stationary contacts to be actuated so as to close the circuit;

a housing to accommodate the movable contacts and stationary contacts;

an arc-extinguishing mechanism disposed in the housing and corresponded to the movable and stationary contacts;

a case connected to a base to accommodate the electromagnetism drive mechanism;

a bedplate associated with the case;

a movable bolt connected with the movable contacts;

a movable iron core connected with the movable bolt to allow the movable bolt to move based on a movement of the movable iron core; and an electromagnetic holding mechanism disposed on the bedplate to hold the movable and stationary contacts to connect the circuit after the movable and stationary contacts are connected, wherein the holding mechanism has an electromagnetic iron, and one of a pothook or a baffle, wherein when the electromagnetic drive mechanism is powered on, the movable iron core is attracted so that the movable bolt is configured to be driven by the movable iron to move to a position, where the pothook hitches the movable bolt or the baffle rams the movable bolt, and the movable contacts move to contact with the stationary contacts, and then the electromagnetic iron of the holding mechanism is powered on to cause the pothook or the baffle to be attracted by the electromagnetic iron to further keep the movable and stationary contacts closed.

2. The electrical switch set forth in claim 1, wherein the holding mechanism further comprising a conducting magnet plate, pothook or baffle intersects the top end of the conducting magnet plate, and has an inclined plane at a position to be in contact with the movable bolt so as to disconnect the movable bolt.

3. The electrical switch set forth in claim 2, further comprising an over-current limiting mechanism disposed on the bedplate to detect and limit an over-current, wherein said over-current limiting mechanism comprises a set of electromagnets corresponding to each of phase circuit and a set of connecting rod mechanism connected with thereof, wherein said connecting rod mechanism comprises a rod which can rapidly thrust aside the movable iron core of the holding mechanism when the over-current occurs, a spring, a pushing plate, a pushing bar and a bracket.

4. The electrical switch set forth in claim 1, further comprising an over-current limiting mechanism disposed on the bedplate to detect and limit an over-current, wherein said over-current limiting mechanism comprises a set of electromagnets corresponding to each of phase circuit and a set of connecting rod mechanism connected with thereof, wherein said connecting rod mechanism comprises a rod which can rapidly thrust aside the movable iron core of the holding mechanism when the over-current occurs, a spring, a pushing plate, a pushing bar and a bracket.

5. The electrical switch set forth in claim 4, further comprising a selection switch mechanism disposed on the bedplate, wherein said selection switch mechanism comprises a set of movable and stationary slide slices, in which the movable slide slice moves along with a turnbutton bar, said selection switch may move both in the rotary direction and in the vertical direction to control the operating state of the switch.

6. The electrical switch set forth in claim 4, further comprising a selection switch mechanism disposed on the bedplate, wherein said selection switch mechanism comprises two sets of micro buttons and a mechanism for connecting and breaking the circuit comprised of a turnbutton, a turnbutton bar, a movable slide slices and a stationary slide slices.

7. The electrical switch set forth in claim 4, further comprising a comprehensive protector, wherein said comprehensive protector has a thermal element action means corresponding to each phase circuit, the thermal element action means can disconnect the said switch when the over-current occurs; and said comprehensive protector further has a phase failure detecting mechanism corresponding to the main circuit which can disconnect the said switch in detecting the phase failure.

8. The electrical switch set forth in claim 1, further comprising a selection switch mechanism disposed on the bedplate, wherein said selection switch mechanism comprises a set of movable and stationary slide slices, in which the movable slide slice moves along with a turnbutton bar, said selection switch may move both in the rotary direction and in the vertical direction to control the operating state of the switch.

9. The electrical switch set forth in claim 1, further comprising a selection switch mechanism disposed on the bedplate, wherein said selection switch mechanism comprises two sets of micro buttons and a mechanism for connecting and breaking the circuit comprised of a turnbutton, a turnbutton bar, a movable slide slices and a stationary slide slices.

10. The electrical switch set forth in claim 1, further comprising a comprehensive protector, wherein said comprehensive protector has a thermal element action means corresponding to each phase circuit, the thermal element action means can disconnect the said switch when the over-current occurs; and said comprehensive protector further has a phase failure detecting mechanism corresponding to the main circuit which can disconnect the said switch in detecting the phase failure.

11. An electrical switch for connecting and breaking a circuit, comprising:

a connecting and breaking mechanism to connect and break the circuit provided with at least a set of movable contacts and stationary contacts;

an electromagnetism drive mechanism to control the movable and stationary contacts to be actuated so as to close the circuit;

a house to accommodate the movable contact and stationary contacts;

an arc-extinguishing mechanism disposed in the housing and corresponded to the movable and stationary contacts;

a case connected to a base to accommodate the electromagnetism drive mechanism;

a bedplate associated with the case;

a movable bolt connected with the movable contacts;

a movable iron core connected with the movable bolt to allow the movable bolt to move based on a movement of the movable iron core;

an elasticity holding mechanism, disposed on the bedplate to hold the movable and stationary contacts to connect the circuit after the movable and stationary contacts are connected, wherein said holding mechanism comprises a spring, a stop button, and a reset button in combination, a pothook or a baffle, and wherein said pothook or said baffle abuts against and contacts with the movable bolt by elasticity, wherein when the electromagnetic drive mechanism is powered on, the movable iron core is attracted so that the movable bolt is driven by the movable iron to move to a position, where the pothook hitches the movable bolt or the baffle rams the movable bolt, and the movable contacts move to contact with the stationary contacts, and then the pothook is hitched or the baffle is rammed by the elasticity of the spring to further keep the movable and stationary contacts closed, and the pothook or the baffle is parted from the movable bolt by pressing the stop button.

12. The electrical switch set forth in claim 11, further comprising an over-current limiting mechanism disposed on the bedplate to detect and limit an over-current, wherein said over-current limiting mechanism comprises a set of electromagnets corresponding to each of phase circuit and a set of connecting rod mechanism connected with thereof, wherein said connecting rod mechanism comprises a rod which can rapidly thrust aside the movable iron core of the holding mechanism when the over-current occurs, a spring, a pushing plate, a pushing bar and a bracket.

13. The electrical switch as in claim 12, further comprising a selection switch mechanism disposed on the bedplate, wherein said selection switch mechanism comprises a set of movable and stationary slide slices, in which the movable slide slice moves along with a turnbutton bar, said selection switch may move both in the rotary direction and in the vertical direction to control the operating state of the switch.

14. The electrical switch as in claim 11, further comprising a selection switch mechanism disposed on the bedplate, wherein said selection switch mechanism comprises a set of movable and stationary slide slices, in which the movable slide slice moves along with a turnbutton bar, said selection switch may move both in the rotary direction and in the vertical direction to control the operating state of the switch.

15. The electrical switch set forth in claim 12, further comprising a selection switch mechanism disposed on the bedplate, wherein said selection switch mechanism comprises two sets of micro buttons and a mechanism for connecting and breaking the circuit comprised of a turnbutton, a turnbutton bar, a movable slide slices and a stationary slide slices.

16. The electrical switch set forth in claim 11, further comprising a selection switch mechanism disposed on the bedplate, wherein said selection switch mechanism comprises two sets of micro buttons and a mechanism for connecting and breaking the circuit comprised of a turnbutton, a turnbutton bar, a movable slide slices and a stationary slide slices.

17. The electrical switch set forth in claim 16, further comprising a comprehensive protector, wherein said comprehensive protector has a thermal element action means corresponding to each phase circuit, the thermal element action means can disconnect the said switch when the over-current occurs; and said comprehensive protector further has a phase failure detecting mechanism corresponding to the main circuit which can disconnect the said switch in detecting the phase failure.

18. The electrical switch set forth in claim 15, further comprising a comprehensive protector, wherein said comprehensive protector has a thermal element action means corresponding to each phase circuit, the thermal element action means can disconnect the said switch when the over-current occurs; and said comprehensive protector further has a phase failure detecting mechanism corresponding to the main circuit which can disconnect the said switch in detecting the phase failure.

19. The electrical switch set forth in claim 11, further comprising a comprehensive protector, wherein said comprehensive protector has a thermal element action means corresponding to each phase circuit, the thermal element action means can disconnect the said switch when the over-current occurs; and said comprehensive protector further has a phase failure detecting mechanism corresponding to the main circuit which can disconnect the said switch in detecting the phase failure.

* * * * *

UNITED STATES PATENT AND TRADEMARK OFFICE

CERTIFICATE OF CORRECTION

PATENT NO. : 7,623,010 B2
APPLICATION NO. : 10/558844
DATED : November 24, 2009
INVENTOR(S) : Ping Liu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 278 days.

Signed and Sealed this

Twenty-sixth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,623,010 B2
APPLICATION NO. : 10/558844
DATED : November 24, 2009
INVENTOR(S) : Ping Liu It is certified that error appears in the above-identified patent and that said Letters Patent is hereby corrected as shown below:

In the Patent Cover Sheet, immediately after the title, insert --RELATED APPLICATION DATA--;
In Claim 2, at column 19, line 21, insert --the-- before "pothook"; and
In Claim 11, at column 20, line 43, remove the "," between "mechanism" and "disposed".

Signed and Sealed this

Twenty-third Day of November, 2010

David J. Kappos

David J. Kappos
*Director of the United States Patent and Trademark Office*